US007823381B2

(12) United States Patent
Misselhorn

(10) Patent No.: US 7,823,381 B2
(45) Date of Patent: Nov. 2, 2010

(54) POWER PLANT WITH HEAT TRANSFORMATION

(75) Inventor: Jürgen K. Misselhorn, Filderstadt (DE)

(73) Assignee: Maschinewerk Misselhorn MWM GmbH, Munich (DE)

( * ) Notice: Subject to any disclaimer, the term of this patent is extended or adjusted under 35 U.S.C. 154(b) by 184 days.

(21) Appl. No.: 11/815,006

(22) PCT Filed: Jan. 27, 2006

(86) PCT No.: PCT/EP2006/000728

§ 371 (c)(1),
(2), (4) Date: May 27, 2008

(87) PCT Pub. No.: WO2006/079551

PCT Pub. Date: Aug. 3, 2006

(65) Prior Publication Data

US 2009/0000294 A1 Jan. 1, 2009

(30) Foreign Application Priority Data

Jan. 27, 2005 (DE) ..... 10 2005 003 896
Mar. 22, 2005 (DE) ..... 10 2005 013 287

(51) Int. Cl.
*F01B 29/10* (2006.01)
*F02G 1/04* (2006.01)

(52) U.S. Cl. ..... 60/520; 60/517; 60/525

(58) Field of Classification Search ..... 60/516–526; 62/6, 520

See application file for complete search history.

(56) References Cited

U.S. PATENT DOCUMENTS

| | | | | |
|---|---|---|---|---|
| 2,366,160 | A * | 1/1945 | Thomsen | 417/53 |
| 3,890,784 | A * | 6/1975 | Tubeue | 60/516 |
| 4,009,587 | A * | 3/1977 | Robinson et al. | 62/116 |
| 4,138,847 | A | 2/1979 | Hill | |
| 5,233,966 | A * | 8/1993 | Berg | 123/27 R |
| 5,325,671 | A | 7/1994 | Boehling | |
| 5,481,878 | A * | 1/1996 | Shaowei | 62/6 |
| 5,537,820 | A * | 7/1996 | Beale et al. | 60/517 |
| 2002/0124561 | A1 | 9/2002 | Ban et al. | |

FOREIGN PATENT DOCUMENTS

| | | |
|---|---|---|
| DE | 26 49 941 A1 | 5/1978 |

* cited by examiner

*Primary Examiner*—Thomas E Denion
*Assistant Examiner*—Christopher Jetton
(74) *Attorney, Agent, or Firm*—Hiscock & Barclay, LLP

(57) ABSTRACT

A power plant with heat transfer, in which power is generated by an arbitrary number of heat engines, described above and illustrated in FIGS. 1 to 18. is disclosed. The heat engines (A) are arranged in series with a cooling medium (22) and a heating medium (30) passing through them in a counter flow principal. After exiting the last heat engine the heated-up cooling medium is used as a combustion air. The heating medium (30) exiting in the opposite direction the last heat engine (A) can be used further on for heating purposes or other heating consumers.

42 Claims, 24 Drawing Sheets

1. Heat Exchanger
2. Working Cylinder
3. Piston
4. Connecting Pipe
5. Valve

LAYOUT

SECTION

P,v Diagram t, s Diagram

POWER PLANT WITH HEAT TRANSFORMATION

TECHNICAL FIELD

The present invention relates to a power plant with heat transformation in which several heat engines as described with the aid of FIGS. 1 to 18 below, placed in series, to utilize the available heat either mainly for power generation or mainly for other purposes, such as heating, or for both simultaneously in variable ratios.

The in the present invention utilized heat engine that operates with external heat sources and operates in accordance with the principle of the Stirling cycle in combination with a cycle, similar to the Clausius Rankine cycle.

The individual cycle consists of six changes of state:

Two isobars, two isochores and two isotherms.

At the same time, but chronologically displaced, several of the cycles described above, take place in this heat engine. The changes of state, expansion and compression of the individual cycles, affect a common working cylinder.

Because of the increasing costs for primary energy from fossil fuels, there is a demand for solutions, which contributes to more efficient use of primary energy. Global warming implicates the avoiding of fossil fuels and the necessity of using regenerative energy. The most commonly used heat engines like diesel- and internal combustion engines (Otto-engines) are used in the road-, ship- and air traffic, and pollute the environment strongly by their $CO_2$ emission. For economic reasons, these engines are usually operated with fuels of fossil origin, such as petrol, diesel oil, kerosene or natural gas. Increasing researches have been made to substitute these fossil fuels by regenerative fuels. Especially researches are done, to use fuels, e.g. hydrogen, rapeseed oil, fermentation gas or other regenerative energy of biomass (e.g., by means of the Fischer-Tropsch process).

Mainly steam and gas turbines, combined heat and power (CHP) units and power generators with diesel or internal combustion engines are the heat engines currently used for power generation. These generators, except the steam generation for steam turbines, operate to a minor extent with regenerative fuels.

All these heat engines have one thing in common, they are only able to transform just a comparatively small part of the used energy, approx. 30-40%, into mechanical work, which is equivalent to electric power. The remaining 60-70% of primary energy is lost as heat energy unless it is used as thermal heat.

In order to utilize this excess energy according to the heat requirements, different heat engines were developed, which also work at low temperatures with acceptable efficiency. One of these developments is the Organic Rankine Cycle (ORC), where organic compounds are employed instead of using water and steam as working substance, whose vaporisation temperatures and vapour pressures allow an operation at low temperatures. In recent years some of the ORC-systems have been taken into operation. By using ORC-systems, regenerative energy like geothermal power can be transformed into work.

To save fossil fuels, the Stirling engine has been increasingly experimented with, since the choice of fuel is insignificant in this heat engine. Heat production takes place independently of power production. The Stirling engine is already manufactured in series, in different versions, by several companies. Amongst others, it is used in small combined heat and power stations (CHP).

The desire to convert solar power into electricity, implicated important impulses to the development of Stirling engines.

In the Stirling heat engine an enclosed gas mass is periodically warmed-up and cooled-down Pressure changes caused thereby are converted into mechanical work by a working piston. The idealized thermodynamic process consists of four changes of state: Compression at constant temperature (isotherm), heat supply with constant volume (isochore), expansion at constant temperature (isotherm) and heat dissipation with constant volume (isochore). Using high pressures, the working gas is pushed back and forth between a warm and a cold space. To improve efficiency, a regenerator is switched between these spaces. The gas flowing to the cold side delivers heat to the regenerator and takes up heat in reversed flow.

As a low-temperature heat power plant, the Stirling engine is economically hardly usable, since the thermodynamic efficiency is very small. Due to mechanical losses, the available output is used mainly internally.

The Stirling engine as a hot gas engine, and the steam plants (including ORC plants) according to the Clausius-Rankine cycle, are the only heat engines with external heat production commonly used.

Water or any other substance evaporates under high pressure (isobars) in the Clausius Rankine cycle. Steam expands isentropically in a turbine into a low pressure level and is again liquified by condensation with equally prevailing pressure (isobaric). Using pumps, the condensate is pumped (isentropic) on the high pressure level again. At this stage, the cycle is starting over again. The Clausius-Rankine cycle consists of 2 isobars and 2 isentropes.

According to the prior art, reference is made to the publications U.S. Pat. No. 4,138,847 "Heat Recuperative Engine" and DE 26 49 941 A1 "Stirlingmaschine und Verfahren zum Betreiben derselben", where a heat engine with heat exchangers is described, whereas a working gas performs an isochoric heat supply and heat dissipation, as well as an isothermal expansion and compression as change of state between two temperature levels. It is the purpose of the invention to utilize waste heat from many processes, namely by improving the utilisation of the isochoric changes of state, and simultaneously to obtain a smaller complex construction.

The present invention is a heat engine, which has a relatively high efficiency, even at low-temperature operating conditions. Among other things, the main purpose of this invention is to recover part of waste heat of industrial process or power stations, which would normally be lost in warm or hot exhaust air. Also part of waste heat, which is transferred normally to the environment by cooling tower or similar process, can be recovered from liquid.

By using this heat engine, mainly part of the lost heat is converted in power, which currently cannot be utilized economically, because of the low temperature level.

In principle, this invention is based on two cycles (the Stirling- and the Clausius-Rankine Cycle), which run simultaneously and complement each other mutually. The Clausius-Rankine cycle takes virtually place within the Stirling cycle, so that the isentropes of the Clausius-Rankine cycle are replaced by isotherms of the Stirling cycle. The Clausius-Rankine cycle consists of two isobars and two isotherms, where these isotherms are a component of both cycles. (see FIG. 16 to 18 in the drawing)

In order to create the possibility of evaporation and condensation, a working fluid is selected, which has a boiling point at an appropriate selected pressure, within the temperature levels required for the operation of the heat engine.

The utilized heat exchanger (closed container with large heat transfer surface) is split up into two halves. The two halves are jointed together using an insulating layer in between, in such a manner that the heat flow from one halve into the other is minimised. The working fluid however is able to flow unhindered as liquid or gas from one half into the other.

The changes of state of the working fluid are converted into work in a working cylinder with a free moving piston. Heat exchangers are connected to the working cylinder by means of connecting pipes with integrated valves, through which the working fluid between heat exchangers and working cylinders can be exchanged. Because of the free moving piston, (i.e. the piston is not connected to a crank shaft by means of a connecting rod) heat exchangers can be connected to the cylinder on both sides of the piston.

Since several cycles run simultaneously in this invention, several heat exchangers are necessary. The minimum number is 3, which have to be connected on one side of the working cylinder. At least 6 heat exchangers are necessary with alternate connection to either side of the working cylinder, 3 on each side. The number of heat exchangers is not limited. Only an odd number of heat exchangers may be attached to each side of the working cylinder. The number of both sides must correspond.

A valve is located in each connection pipe, which is opened by means of an opening mechanism (e.g. cam disk or by means of an electric actuator) during a certain period. During one cycle the valve opens and closes two times, once for the compression and once for the expansion stage.

The heat exchangers are arranged in a star shaped manner around the working cylinder and rigidly connected with it. Together with the working cylinder they form a rotor, which constantly turns around its own longitudinal axis. For each entire rotation, a complete cycle takes place in each heat exchanger.

The piston in the working cylinder is moving free. The different cycles act from both sides on the piston. While a compression takes place on the one side, an expansion simultaneously takes place on the other side.

The six changes of state proceed in the following order (see FIG. 17, P-v-diagram or FIG. 18, t-s-diagram).

1. Isochoric Heat Extraction

The working fluid is cooled in a heat exchanger at a constant volume. The heat exchanger consists of 2 parts, which are thermally decoupled in the centre, by an insulating layer. Only one part of the heat exchanger is cooled down up to condensation temperature of the working fluid.

2. Isobaric Condensation

If the condensation temperature is reached, the vapour of the working fluid proceeds to condense at constant pressure and temperature. The valve between the working cylinder and heat exchanger opens and additional vapour of the working fluid flows, due to the compression, streams into the heat exchanger, partly because of the negative pressure in the same heat exchanger, partly because of the external pressure on the piston in the working cylinder. Due to continuous cooling, more vapour of the working fluid is condensed.

3. Isothermal Compression

While the working gas from the working cylinder flows into the heat exchanger, heat is extracted from the heat exchanger. Vapour of the working fluid condenses not entirely but densifies with simultaneous heat extraction. The valve closes.

4. Isochoric Heat Input

Because of the isothermal compression, a larger mass of the working fluid is now enclosed in the heat exchanger. During the continuous rotation, the condensate of the working fluid flows from the cooled half into the other half of the heat exchanger and is heated to the upper temperature level by the heating medium. This temperature is higher than the boiling point of the working fluid. A part of the working fluid evaporates. In order to avoid simultaneous condensation in the cooled halve of the heat exchanger, the connection port between both parts is mechanically closed or the cooled part of the heat exchanger is heated in a regeneration process.

5. Isobaric Evaporation

Heating the heat exchanger to the upper temperature level will evaporate the working fluid. The condensate of the fluid will evaporate until the pressure within the heat exchanger reaches the vapour pressure of the working fluid. The valve is opened again. Due to the pressure, the working fluid flows out of the heat exchanger into the working cylinder while more heat is transferred to the heat exchanger. Due to the falling pressure and continuous heat supply a further part of the condensate evaporates 6. Isothermal Expansion After the remaining part of the condensate is evaporated, the vapour of the working fluid continues to expand into the working cylinder with simultaneous heat supply. The valve closes.

Several heat exchangers are individually connected with the working cylinder by means of a connecting pipe 4. The same process takes place, in each heat exchanger. The individual processes (illustrated as Stirling cycles) of the different heat exchangers are chronologically displaced. In FIGS. 13A, 13B and 13C the sequence of the different processes and their relationship between each other is schematically illustrated.

A possible design modell of this heat engine, where the Stirling- and the Clausius-Rankine cycles can both be implemented together, is schematically illustrated in FIG. 12.

The present invention relates to a heat engine, but with reference to FIG. 19 to 21 specially relates to a described power plant with heat transfer.

PRIOR ART

For better utilization of energy heat transformation is applied in many large and small power plants. In power plants which operate according to the Clausius-Rankine cycle, the steam is condensed partially or completely in heat exchangers, the remaining steam is then condensed in cooling towers or air cooled condensers or in other processes. The heat recovered in the heat exchangers is now available for heating, district heating or other applications.

In Organic Rankine cycles part of the heat which originates from combustion processes is tapped off in an thermal oil circuit with which in turn the working fluid of a Organic Rankine cycle is evaporated to propel a steam turbine and power generator in a Clausius-Rankine cycle. Heat that accumulates from condensation of the working fluid is used for heating water or is disposed to atmosphere by means of air cooled condensers.

In combined heat and power plants (CHP) with internal combustion engines the waste heat from cooling water, oil coolers and from combustion gases is used for heating and other purposes.

Regarding the prior art reference is made to heating plants in which part of the generated heat is transformed into power by Sterling engines.

If the plants described above are operated heat orientated, i.e. operated according to heat demand, a high annual efficiency but a poor utilization factor can be achieved. If the combined heat and power plant (CHP) is operated power orientated, then during times when waste heat cannot be used completely and is dissipated to atmosphere by cooling towers or air coolers, there will be heat losses. These losses reduce the annual efficiency and utilization factor.

With the present invention the combined heat and power plants can be operated at full load over the whole year because power or heat or both together can be generated with virtually the same efficiency. Thus a much higher annual efficiency and utilization factor can be achieved. Power can also be transferred from process waste heat by this invention.

SUMMARY OF THE INVENTION

A heat engine is described, which has an external heat source and at least 3 heat exchangers 1 with contained working gas, which are alternately charged with heating and cooling mediums. The thermodynamic changes of state in each heat exchanger 1 connected to a working cylinder 2 and valve actuator 5 and 6 are a) isochoric heat supply, b) isothermal expansion, c) isochoric heat dissipation and d) isothermal compression.

The heat exchangers 1, connecting tubes 4 and valves 5 are rigidly connected to the working cylinder 2 and rotate with these one around the common longitudinal axis. During one rotation each heat exchanger 1 is heated up for a half rotation and cooled down for the other half rotation. Expansion and compression are released by valve 5 in between heat exchanger 1 and a common working cylinder 2 as a function of the heating/cooling procedure. Work is performed, in the common working cylinder 2 by expansion and compression.

The successively following changes of state: Expansion and compression do not take place with the same working gas. After the expansion out of a heated heat exchanger 1 into the working cylinder 2, a compression in another cooled heat exchanger 1 follows.

Variations of different combinations of heat exchanger 1, working cylinder 2, connection pipes 4 and valves 5 and varieties with demonstration for the use of radiation energy are pointed out.

Variations with magnetized working piston 3 and working cylinder 2 surrounded by an electrical coil were described, for a direct generation of power as well as working pistons 3 coupled to piston rod, wave and flywheel.

Different variations of this heat engine using a working fluid, what condenses and evaporates during the cycle. The heat exchangers 1 are divided into two parts for these variations, while forming together the enclosed space in which the changes of state of the working fluid is performed, which are however thermally decoupled among themselves, wherein one part is heated and the other one is cooled. During cooling and compression a part of the working fluid condenses. By the accordingly selected construction of the heat exchangers 1 and by the rotation of the same one, the condensate flows into the heated part. Also during the expansion, the condensate of the working fluid evaporates again with constant heat supply. During the heat supply, condensation in the cooled part of the heat exchanger 1 is avoided between the cooled and heated part, by mechanical locking of the connections 26.

Expansion and compression are released, by valve 5 between heat exchangers 1 and a common working cylinder 2, as a function of the heating/cooling procedure. In the common working cylinder 2 work is performed by expansion and compression.

In this variation a thermodynamic cycle with the changes of state: 1. isochoric extraction of heat, 2. isobaric liquefaction, 3. isothermal compression, 4. isochoric heat input, 5. isobaric evaporation and 6. isothermal expansion becomes realized. In this variation also a solution for the use of radiation energy as well as a solution, using a rotary machine in stead of the working cylinder 2 and working piston 3, were described.

DEFINITION OF TERMS

Figure 1:
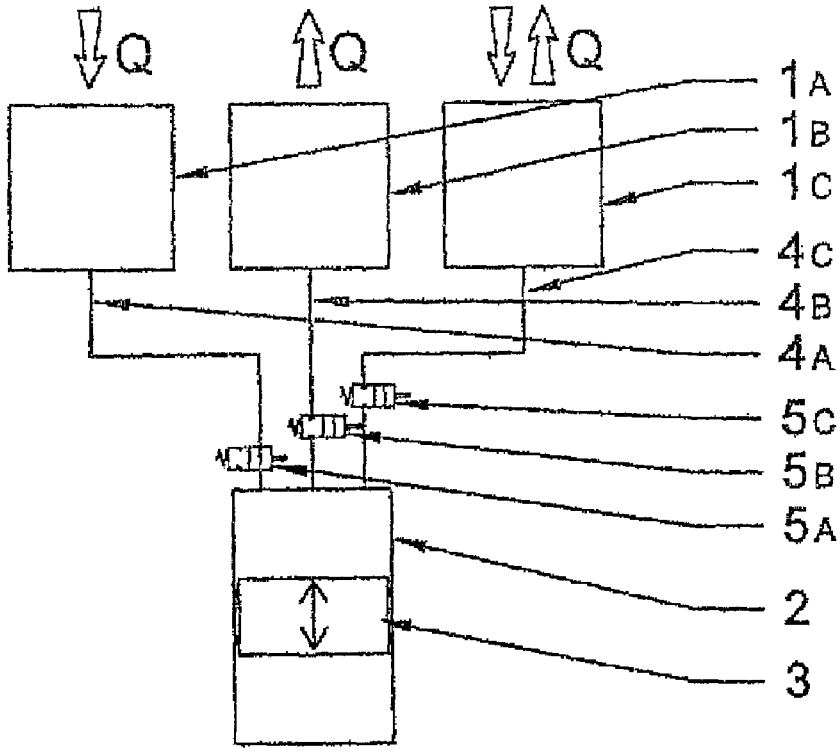
FIG. 1 a schematic diagram of the basic module, in which the substantial components and their relationship to each other are pointed out in order to describe the implementation of the Stirling cycle.

In the following description the medium with the lower temperature is named "cooling medium" and that with the higher temperature "heating medium".

In the following description, the term "to heat" is used for the procedures "to warm" as well as "to heat".

Description of the Cycle Corresponding to the "Stirling Comparative Cycle"

The thermodynamic process consists of 4 changes of state, with a sequence corresponding to the Stirling cycle In a closed space with large heat exchange surface (subsequently named heat exchanger 1), the working gas is heated or cooled periodically by a (liquid or gas) medium streaming around the closed space. It is also possible to heat up the working fluid by radiation energy (e.g. solar energy). Pressure differences caused by heating or cooling are transferred onto the working piston 3 after valve 5 between the enclosed space in heat exchanger 1 and the stroke volume of the cylinder has been opened.

The four changes of state of the working fluid are:

1. Heat supply at constant volume (isochore)—valve 5 closed.
2. Expansion at constant temperature (isotherm) (with heat addition)—valve 5 opened.
3. Heat supply with constant volume (isochore)—valve 5 closed
4. Compression at constant temperature (isotherm) (with heat extraction)—valve 5 opened.

The main difference between the Stirling engine and this invention is, that the compression stroke following the expansion stroke of the piston 3, is not from the same heat exchanger 1. There are at least three heat exchangers 1 necessary, which are alternately and periodically warmed up or cooled down.

In each individual heat exchanger 1 in conjunction with the common working cylinder 2 and piston 3, a separate cyclic process is taking place but chronologically displaced to all other heat exchangers 1.

In the common working cylinder 2, the individual Stirling cycle processes are co-ordinated in such a manner that an isothermal compression of a heat exchanger 1 follows an isothermal expansion of another heat exchanger 1 etc. After this compression an isothermal expansion of a further heat exchanger 1 follows again etc.

Similar to a Stirling engine no internal combustion is taking place. Heat and power are generated separately. That means that this heat engine can also be operated with dedicated external heat source and thus represents a self-sufficient plant. Anything producing heat can be used as primary energy.

Compression and expansion takes place mainly outside the piston displacement space, therefore no flywheel or similar is required. Mechanical linkages afflicted with friction losses impairing the efficiency of the machine, are not required. Contrary to conventional heat engines the movement of the piston 3 can be converted directly into electricity. Electrical windings around a non-metal working cylinder 2 and a magnetized piston 3 are required, for this purpose.

Construction of the Basic Module

Figure 2:
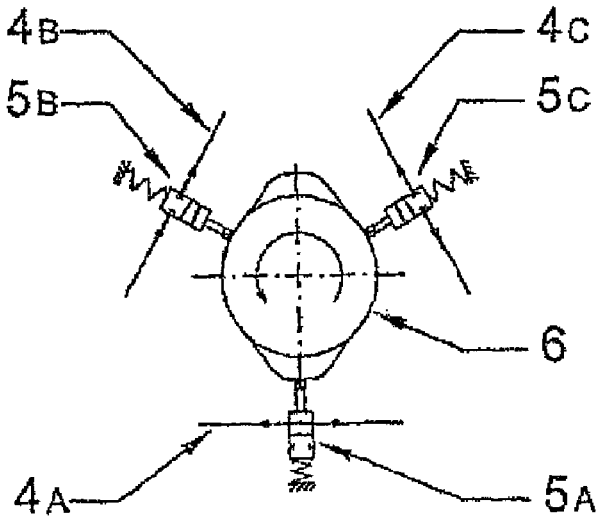
FIG. 2 Details of the valve actuator 5 and 6.
Figure 8:
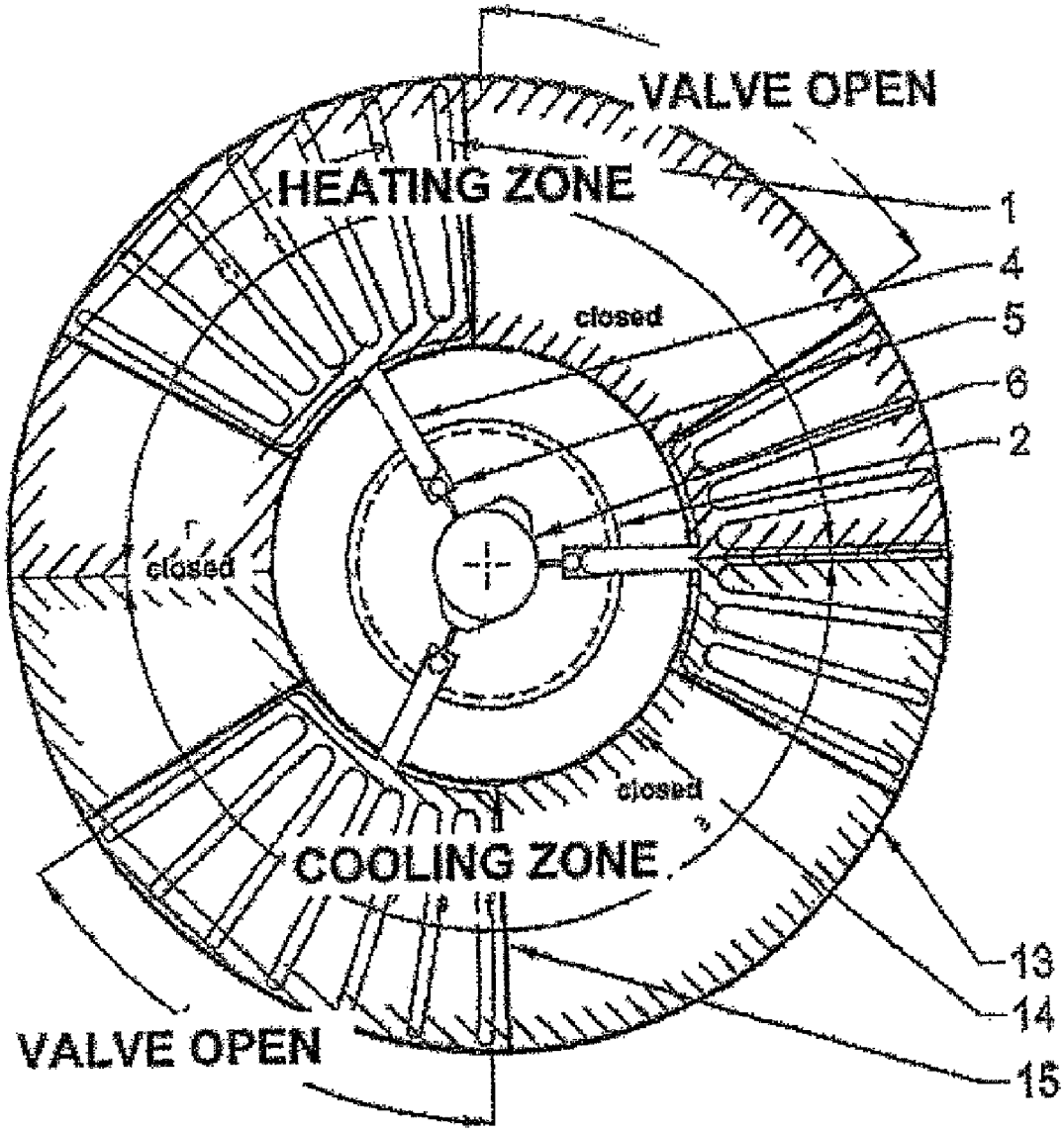
FIG. 8 a schematic model of the basic module designed with heat exchangers 1, which are arranged in a star shaped manner around the working cylinder 2 and consequently form a rotor. They rotate together around the common longitudinal axis. In the drawing the arrangement and function of the connecting tubes 4, the valves 5 as well as the valve actuator 6 are emphasized. The heating and cooling section of the heat exchangers 1 are indicated.

The heat engine is schematically illustrated in FIGS. 1, 2 and 8.

Essentially the illustrated heat engine comprises:

1. Heat exchangers 1A, 1B and 1C, which are in form of a rotor arranged in a star shaped manner around a working cylinder 2 and rotate together with it around its longitudinal axis. The heat exchangers 1A, 1B, 1C etc. are all referred to as 1. Due to the rotating motion the separate heat exchangers 1 move through a cooling medium stream for half of one rotation (cooling section) and for half of one rotation through the heating medium stream (heating section), so that they are alternately immerged in a cooling- and a heating medium.

Figure 10:
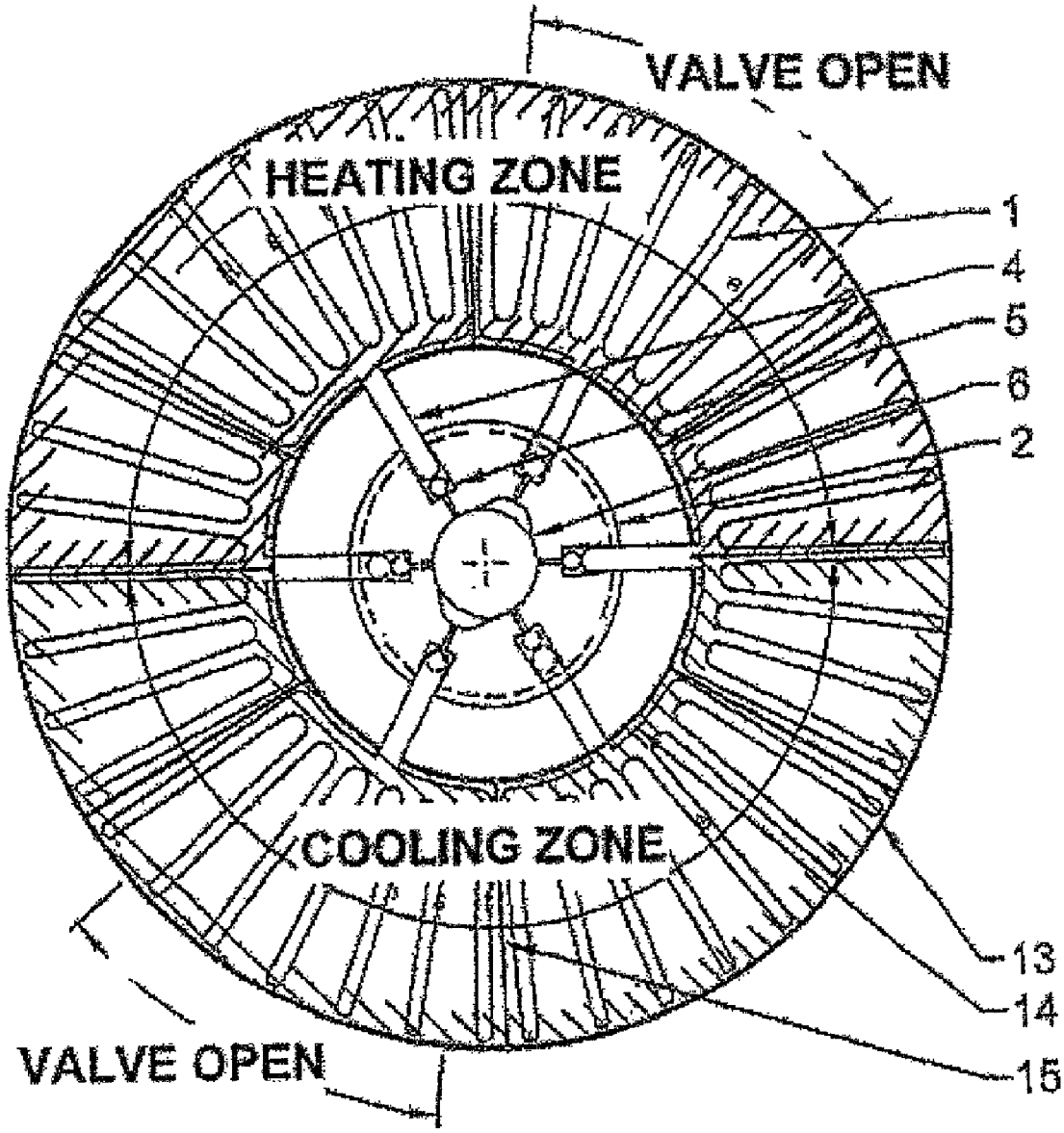
FIG. 10 a schematic model of the basic module, designed with 3 heat exchangers 1 attached on either side of the working cylinder 2. Also in this model the heat exchangers 1 are arranged in a star shaped manner around the working cylinder 2 and consequently form a rotor. Together they rotate around the common longitudinal axis. The heating and cooling sections of the heat exchangers 1 are identified.

Heat exchangers 1 are closed spaces with a single connection to the working cylinder 2. The heat exchangers 1 are located in a pipe, which covers them from the outside and form in this way an outside cover 13 (FIG. 10). Similarly, a pipe is provided, which is located on the inside, between heat exchanger 1 and working cylinder 2 that forms an inside cover 14. These covers 13 and 14 have the same length as the heat exchangers 1. They form a annulus duct, in which the heat exchangers 1 are located. Between the individual heat exchangers 1 separating partitions 15 are provided, which reach from the outside to the inside cover. Consequently each heat exchanger 1 is located in a duct, through which the heating and cooling medium is conducted and therefore surround the individual heat exchanger 1.

Each heat exchanger 1 is, except for one opening, entirely closed. The opening is connected to the working cylinder with a pipe 4 and a valve 5 through which the working gas can flow in and out.

The heat exchangers 1 are manufactured from a material with very good heat conducting properties (e.g. Ag, Cu or Al).

2. In a working cylinder 2 a piston 3 can move freely back and forth. To achieve good efficiency, a surface with low thermal capacity and bad heat conductivity is required on the inside, as well as good sliding quality (e.g. Teflon)

(as little heat as possible should be transferred from the working gas to the working cylinder 2 or vice versa).

For power generation an electric coil 8 is placed around the working cylinder 2. The working cylinder 2 itself is manufactured of a non-metallic material (glass, ceramic(s), plastic or similar). At one or at both sides openings are provided, to which the connecting pipes 4 are connected with the space inside the working cylinder 2.

3. A free moving piston 3 without piston rods or other mechanical connections, which can freely move back and forth in the working cylinder 2. Similar to a petrol engine, the piston 3 is sealed off against the walls of the working cylinder 2.

In order to improve the efficiency, surfaces of the piston 3, which are in contact with the working gas are provided with a surface with low thermal capacity and bad heat conductivity. To minimize acceleration work, it is beneficial to keep the mass of the piston 3 as small as possible.

In order to be able to generate electricity directly from the piston movement, the piston 3 must be magnetized. This magnetization is described in number 7.

4. Connections, in particular connecting pipes 4A, 4B and 4C, are connections which connect the internal space of the individual heat exchangers 1A, 1B and 1C with that of the working cylinder 2. Connections 4A, 4B and 4C etc. will in total be referred to as 4. These connecting pipes 4 are kept as short as possible to avoid unnecessary dead space. If possible the connecting pipes 4 should have a small thermal capacity and heat conductivity. Wherever these connecting tubes 4 are not surrounded by cooling-/heating medium, they are isolated against heat exchange with the environment. Control valves 5 are installed, in these connecting pipes 4, as far as they are not integrated in the working cylinder 2.

5. Control valves 5, consisting of individual valves 5; each installed in the connecting pipe 4 between heat exchanger 1 and working cylinder 2 and govern the actual process. The application not the construction of these valves 5 is a substantial characteristic of this invention.

For each heat exchanger 1A, 1B and 1C a valve 5A, 5B and 5C is provided. Valves 5A, 5B, 5C etc. will in total be referred to as 5. The valves 5 will alternately be opened and closed, in order to connect or separate the space inside the individual heat exchangers 1 with that of the working cylinder 2. The space in each heat exchanger 1 is directly connected with that in the working cylinder 2 when valve 5 is opened. The valves 5 are hermetically sealed and are designed for the maximum pressure difference between heat exchanger 1 and working cylinder 2.

6. A valve actuator 6 is designed to open and close the valves 5, in the right moment. The valve actuation 6 can be effected mechanically (e.g. with a cam shaft/-disk) or electrically/electronically. The valves 5 are opened and closed in the same rhythm, as the heating and cooling of the heat exchanger 1. At the end of a heating or a cooling process of a heat exchanger 1, the valve 5, which is assigned to the heat exchanger 1, is opened and by doing so, it initiates the expansion or compression. After expansion or compression, but before the heat exchanger 1 changes from the heating to the cooling medium, or vice versa, valve 5 closes.

7. Magnetization of the working piston 3 with permanent magnets 7 or with excitation coil. The excitation power is transferred by means of sliding contacts from the cylinder 2 to the piston 3.

8. An electrical coil 8, placed around the working cylinder 2, in which, as a result of the movement of the magnetized piston 3, power is produced.

9. A pressure balancing tank 9, which is used only for working cylinders 2 where heat exchangers 1 are attached on one side only. A pressure tank filled with working gas, which provides the pressure balance, if the static pressure in the heat exchangers 1 deviates from the atmospheric pressure.

10. A circulation air fan 10 or a circulation pump 10, which circulates the medium, from the heated heat exchangers 1, immediately after the expansion procedure (after closing the valve 5) to the cooled heat exchangers 1 at the end of the compression phase (after closing the valve 5). With this circulation a part of the heat, that is stored in the heat exchanger walls, is exchanged, in order to heat-up the cooled heat exchangers 1 and cool-down the heated ones. By this regeneration process more heat of the heating medium is available to heat the working gas.

Figure 11:
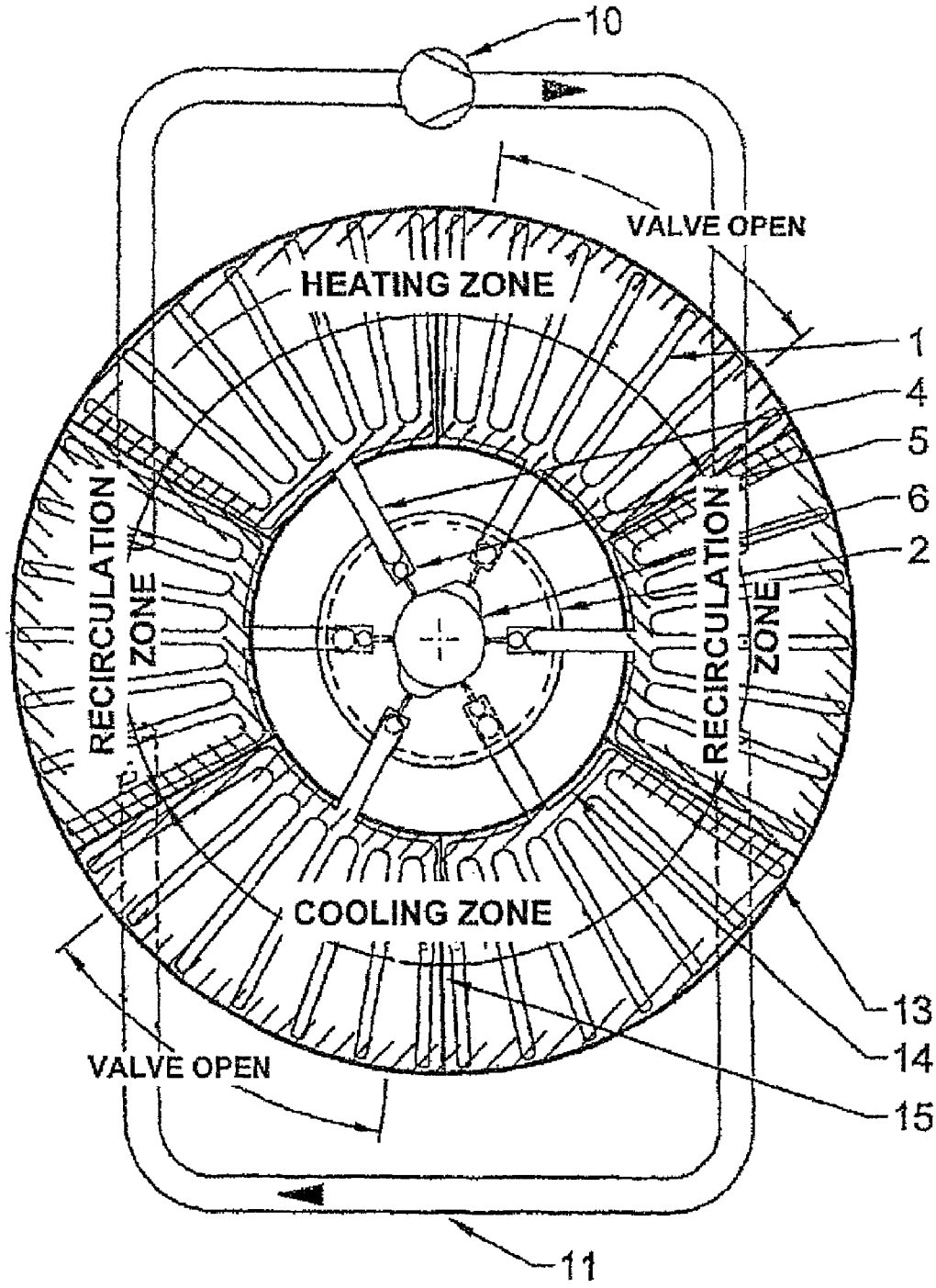
FIG. 11 Model, as shown in FIG. 10, supplemented with a regenerator consisting of circulating fan 10 or circulation pump 10 with circulation air ducts 11 or circulation pipes 11 (liquids).

11 Circulation ducts or pipes 11, which conduct the heating/cooling medium of the heated heat exchangers 1 to the cooled heat exchangers 1 and from there to fan/pump 10 and back to the heated heat exchangers 1 (see FIG. 11).

12 An isolated segregation wall 12 in between the heating and cooling sector (see FIG. 12) in form of a pipe, to separate the heating medium from the cooling medium within the rotor.

13 An external cover 13 around the heat exchangers 1 and part of the duct which conduct the heating/cooling medium around the heat exchangers 1. Together with the internal cover 14 and the segregation partitions 15, the external cover 13 forms an annulus-section shaped duct around each individual heat exchanger 1.

14 An internal cover 14 is provided to construct a pipe-shaped border of the medium duct towards the working cylinder 2. Together with the external cover 13 and the segregation partitions 15, the internal cover 14 forms an annulus-section shaped duct around each individual heat exchanger 1.

15 The segregation partitions 15 are limitations between the individual heat exchangers 1. Together with the internal cover 14 and external cover 13 they conduct the heating/cooling medium during the rotation around the respective heat exchangers 1.

Description of the Process with the Aid of the Basic Module

The process cycle is explained on the basis of a model, with warm air as energy source. This model is illustrated schematically in FIG. 8. The process sequence is schematically illustrated in FIGS. 9A, 9B and 9C.

The model consists of 3 heat exchangers 1, which are arranged in a star shaped manner around the working cylinder 2. The angle between the neighbouring heat exchangers 1 amounts to 120° each. The heat exchangers 1 are rigidly connected with the working cylinder 2 and rotate together with it, as well as with the external cover 13 and internal cover 14, around its longitudinal axis. The heat exchangers 1 alternately move into spaces, through which heating or cooling media flow, which are called heating and cooling zones in FIG. 8. Ducts that conduct the cooling and heating media, are connected to the in and outflow of the heat exchanger's annulus shaped duct. Each of the two kinds of media, is directed to half of the annulus, in which the heat exchangers 1 are located.

In this model, the valve actuator 6 is represented as cam disk, and is arranged in such a manner, that by rotation of the rotor the tappets of the valves 5 follow the outlines of the cam disk 6. The cam disk itself is fixed. It has two opposing cams. They are arranged in such a manner, that the valves 5 are opened at that moment, when the corresponding heat exchanger 1 covers approximately ⅔ of the respective cooling or heating zones. Valve 5 closes shortly before the heat exchanger 1 of the cooling medium crosses over to the heating medium (or vice versa).

Figure 9A:
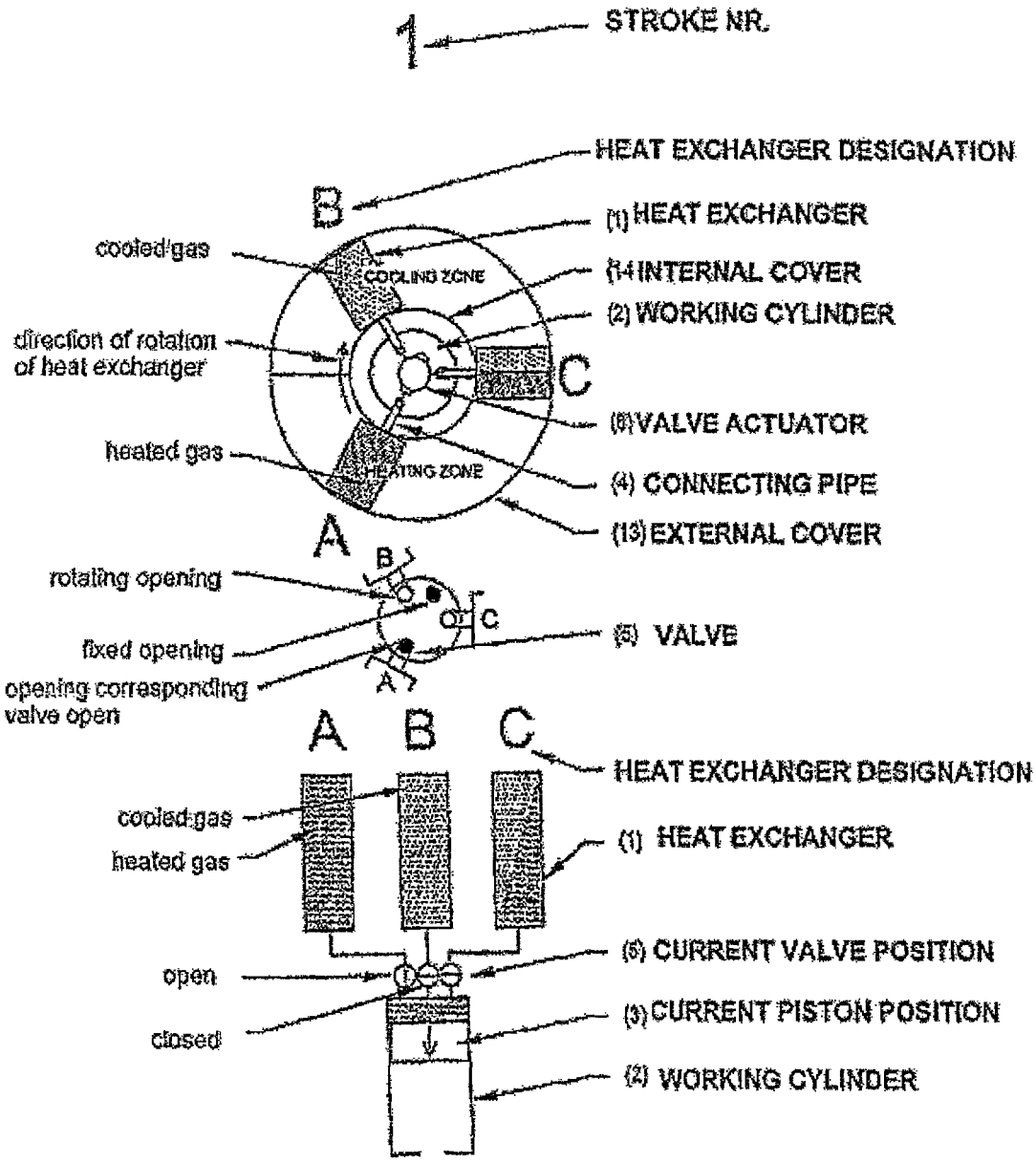
FIG. 9A "Symbol description" and pertaining FIG. 9B "showing stroke 1 to stroke 4" and FIG. 9C "showing stroke 5 to stroke 6", an illustration of the process sequence based on the model shown in FIG. 8. The respective piston movement, the valve position and the progress of the individual heat exchanger in the Stirling comparative cycle, are schematically illustrated.
Figure 9B:
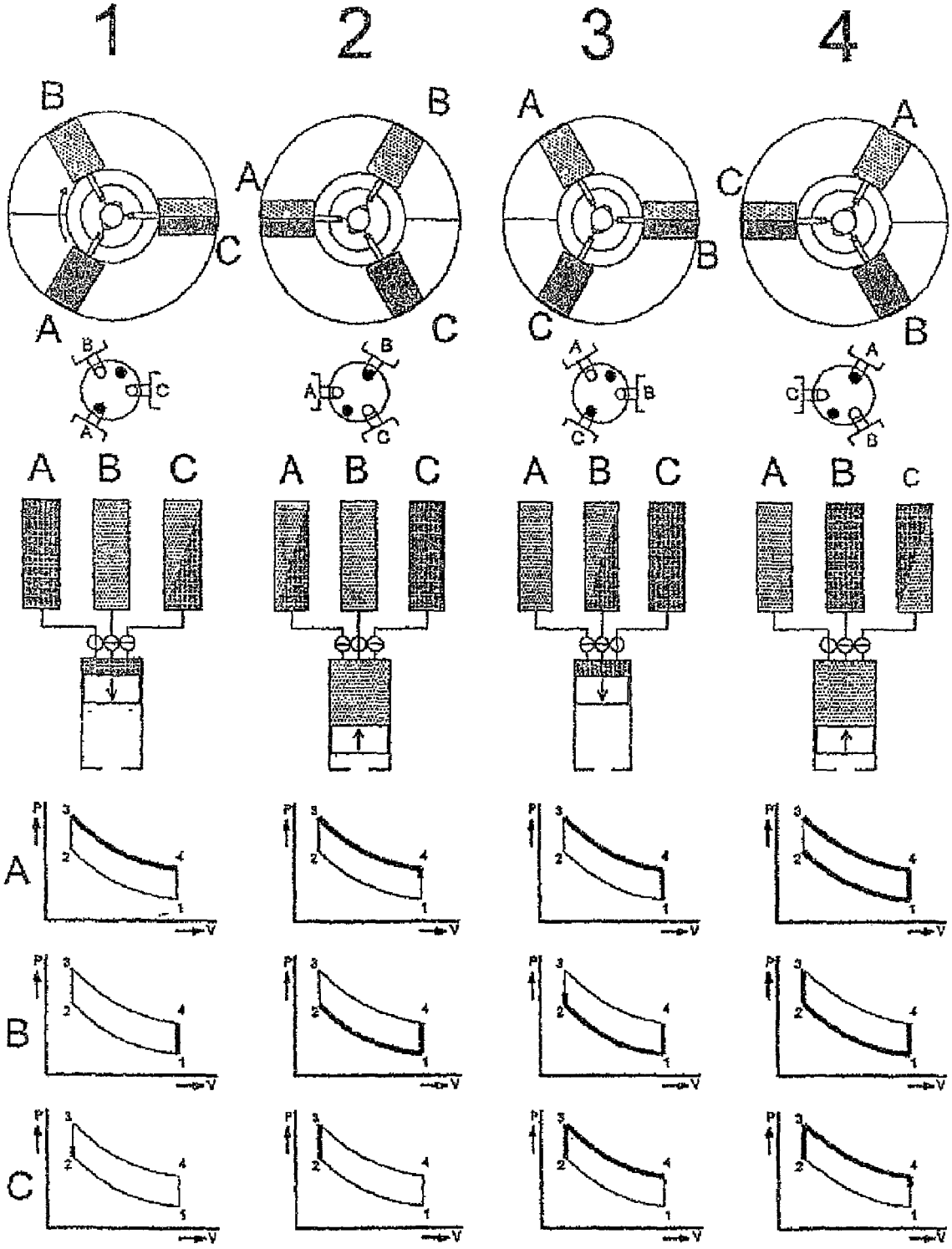
Figure 9C:
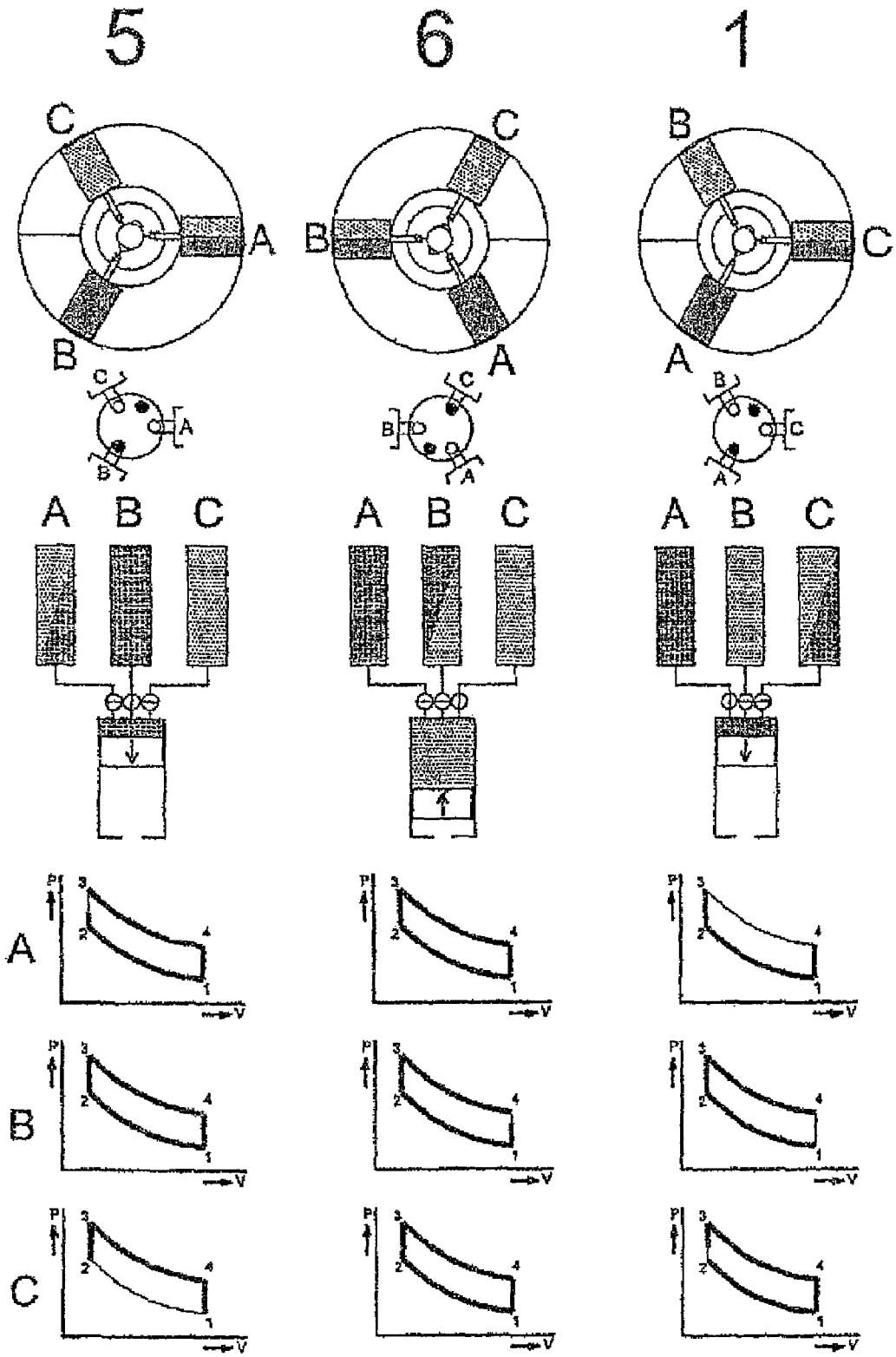

The process in the individual heat exchangers 1 proceeds as schematically illustrated in FIG. 9A to 9C. In this model it is assumed, that the rotation of the heat exchangers 1 and working cylinder 2 occurs by means of an external drive.

Stroke 1:

The heat exchanger 1A is already immerged in a hot air stream and the enclosed working gas is already warmed up. By heating-up and through the limited space the pressure in the heat exchanger 1A increases at a constant volume (isochores). By rotation the cam plate 6 opens valve 5A. Working gas which is under pressure expands into the working cylinder 2 and performs work by movement of the piston 3. During the expansion, the heat exchanger 1A is still immerged in hot air. Consequently an isothermal expansion takes place.

Stroke 2:

While the piston 3 moves away from the valve 5A, the working cylinder 2 and heat exchangers 1 continue with the rotation and the valve 5A closes. At the same time another valve 5B opens, which now connects the space in the working cylinder 2 with that of the heat exchanger 1B. The heat exchanger 1B was immerged in the cooling medium. In the heat exchanger 1B concerned, the enclosed gas, was cooled down with constant volume, resulting in a negative pressure. By opening the valve 5B, gas from the working cylinder 2 is compressed into heat exchanger 1B and the piston 3 moves back to the valve 5B, because of the pressure difference. Since the heat exchanger 1B is constantly immerged in a cooling medium stream and the working gas is deprived of heat during this compression procedure, it becomes an isothermal compression.

At this time heat exchanger 1A is already partly immerged in a cold air stream.

Stroke 3:

While rotating and the piston 3 having moved back and forth, the third heat exchanger 1C was immerged in a heating medium. With constant volume, the pressure of the working gas in the heat exchanger 1C increased. By opening the valve 5C, the working gas expands isothermically from the heat exchanger 1C into the working cylinder 2 and pushes the pistons 3 away from the valve 5.

Stroke 4:

While the piston 3 is moving away and due to the rotation, the heat exchanger 1A was immerged in cooling medium. Since the valve 5A is closed, heat was extracted from the working gas in a constant volume (isochores). Thereby a negative pressure of the working gas developed in the heat exchanger 1A. After further rotation the valve 5A opens. Due to the negative pressure the pistons 3 is returned again.

Stroke 5:

The heat, which was supplied to the working gas in the heat exchanger 1B by the heating medium and due to the constant volume a positive pressure has developed in the heat exchanger 1B, which is able to expand by opening the valve 5B to the working cylinder 2. The piston 3 is forced away again by this (isothermal) expansion.

Stroke 6:

The heat, which was now extracted from the working gas in the heat exchanger 1C by the cold medium and at a constant volume in the heat exchanger 1C has produced a negative pressure. When opening the valve 5C, the working gas from the working cylinder 2 will compress into the heat exchanger 1C. The piston 3 returns back again due to this (isothermal) compression.

After stroke 6 the procedure is repeated staffing from stroke 1. For each complete rotation of the rotor, each heat exchanger 1 is connected twice to the working cylinder 2 by means of valves 5, once for the expansion and once for the compression phase.

With the external drive a speed regulation of the rotor, is possible, in order to optimize the performance of the different cycles, e.g. with changing parameters of the heating or cooling medium.

Figure 3:
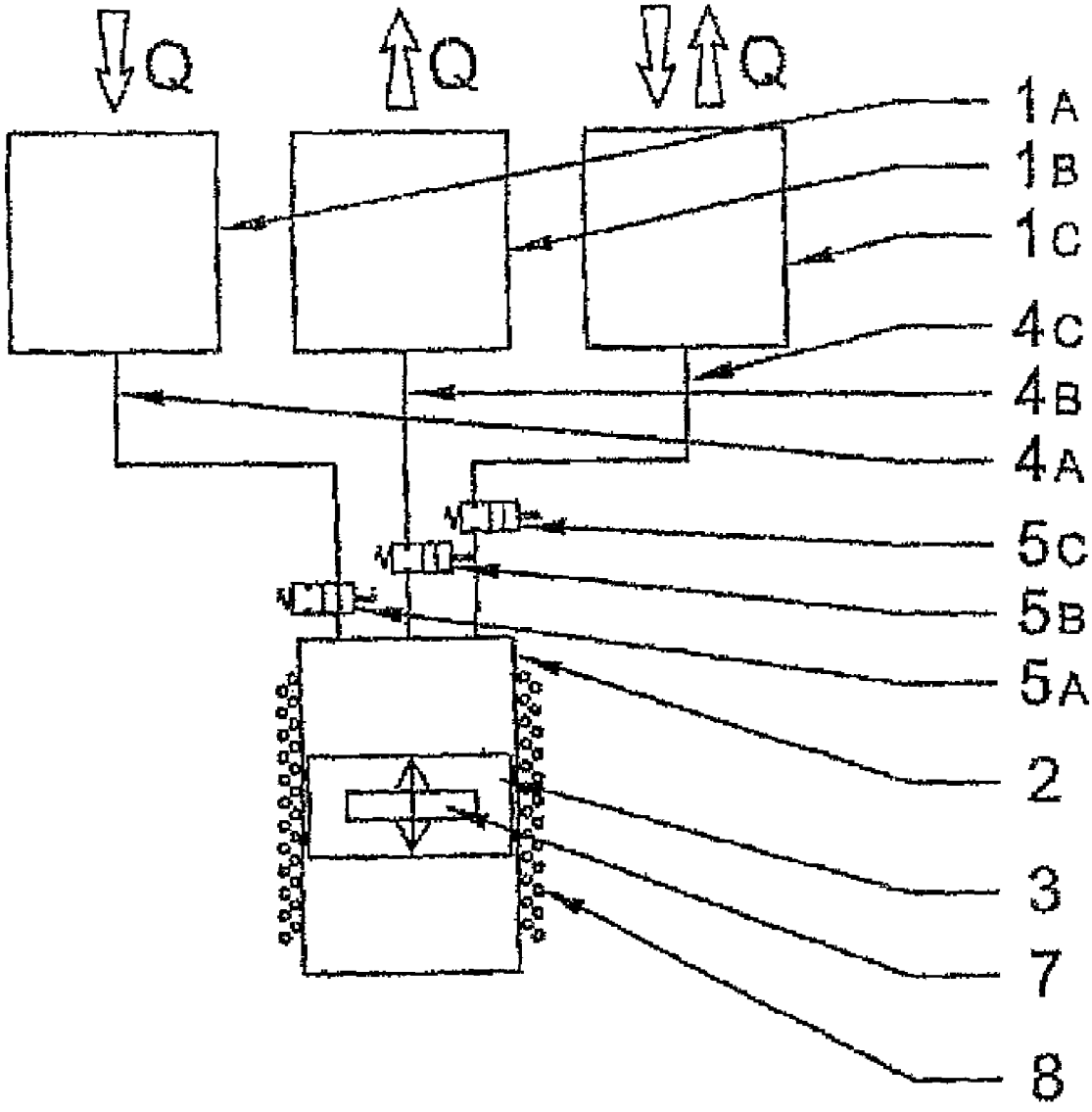
FIG. 3 the basic module of FIG. 1, supplemented by electrical coil 8 and magnet 7 for direct power generation FIG. 4 the basic module of FIG. 1, supplemented with a pressure equalizing vessel 9, for an undefined operating pressure of the working fluid FIG. 5 another design of the basic module, where the heat exchanger 1, connecting pipes 4, valves 5 and valve actuator 6 are arranged on both sides of the working cylinder 2

First Variation to the Basic Module (See FIG. 3)

Heat engine, as described for the basic module, but with a working cylinder 2, which is made of a non-metallic material (glass, ceramic, plastic or similar). A wire coil 8 placed around the working cylinder 2 for power generation.

The free moving piston 3 is magnetized by permanent magnets 7, or by means of electric excitation. By moving the piston 3 back and forth, power is produced in the coils 8 around the working cylinder 2.

Figure 4:
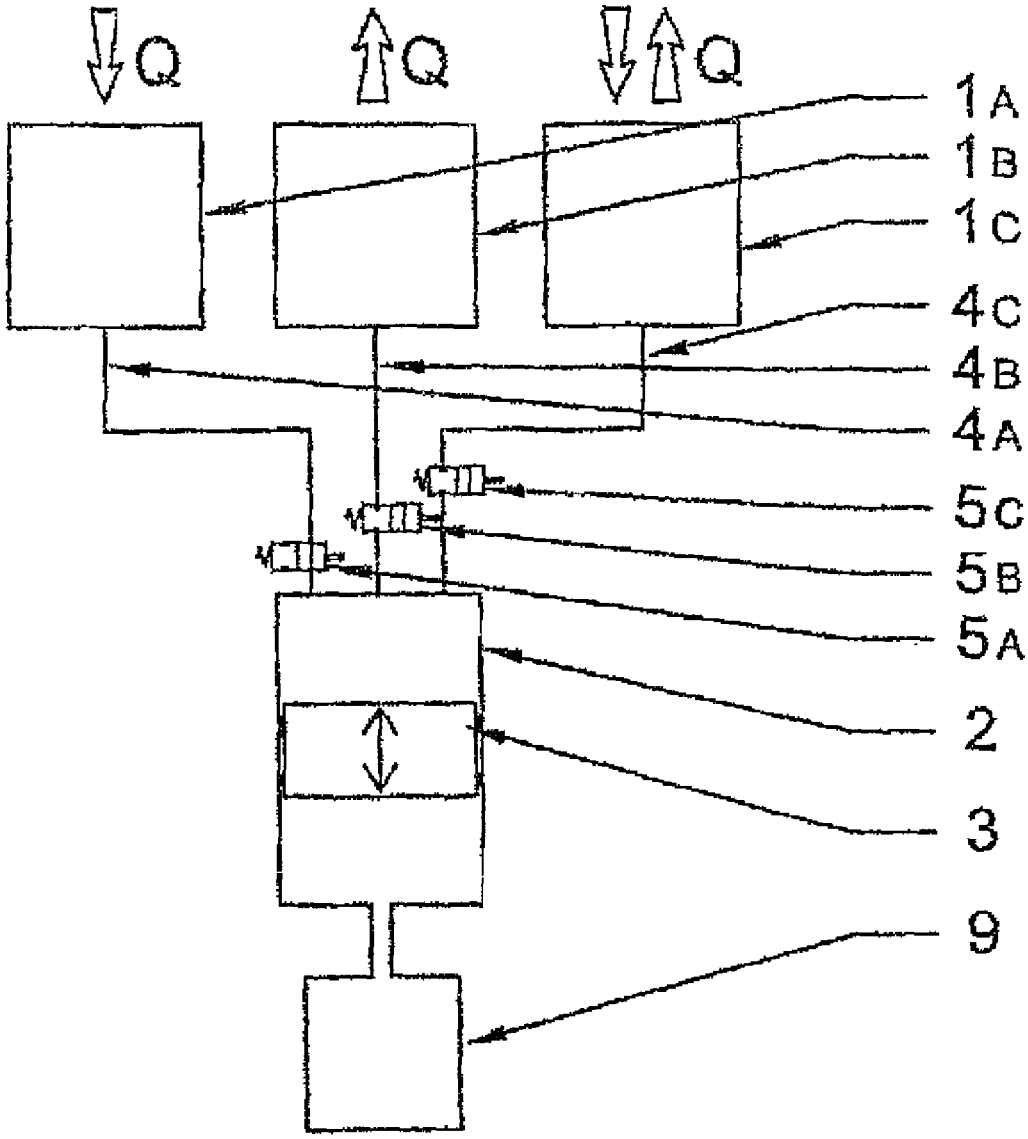

Second Variation of the Basic Module (see FIG. 4)

If the working cylinder 2 is open to the atmosphere, a one-sided load on the piston 3 is affected by working gas, when the static pressure of the working gas deviates from the atmospheric pressure. The choice of the working gas is substantially limited by this. If it should be necessary to work with pressures, other than the atmospheric pressure, an equalizing pressure vessel is attached to the open side of the piston 3, which shall provided the necessary counter-pressure.

Figure 5:
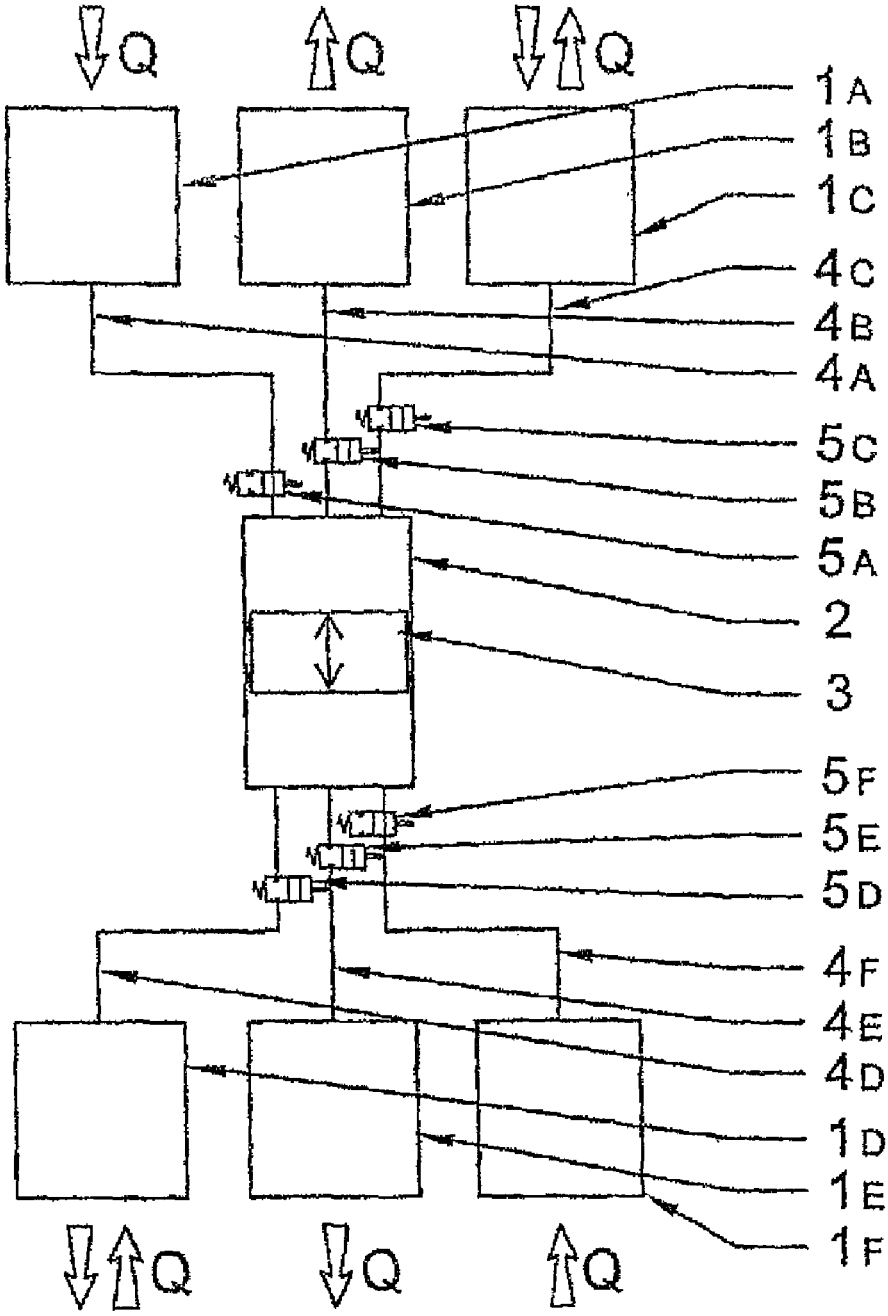
Figure 13A:
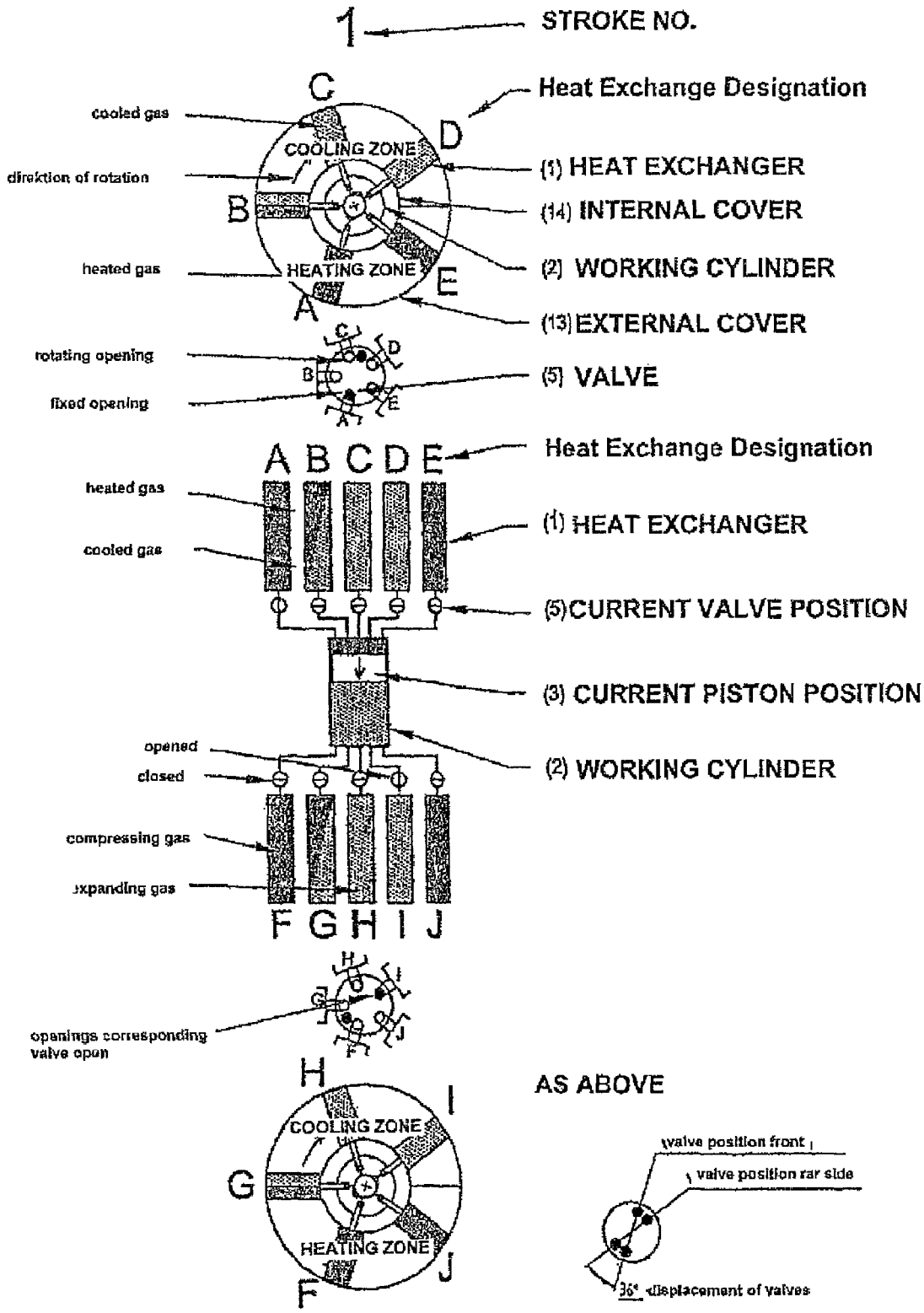
FIG. 13A "Symbols Description" and the pertaining FIG. 13B "diagrams stroke 1 to stroke 4" and FIG. 13C "diagram stroke 5 to stroke 7", a diagram of the first 7 strokes of 10 strokes of the process, based on the model presented in FIG. 6, but each with 5 pcs. of heat exchangers 1 on either side of the working cylinder 2.
Figure 13B:
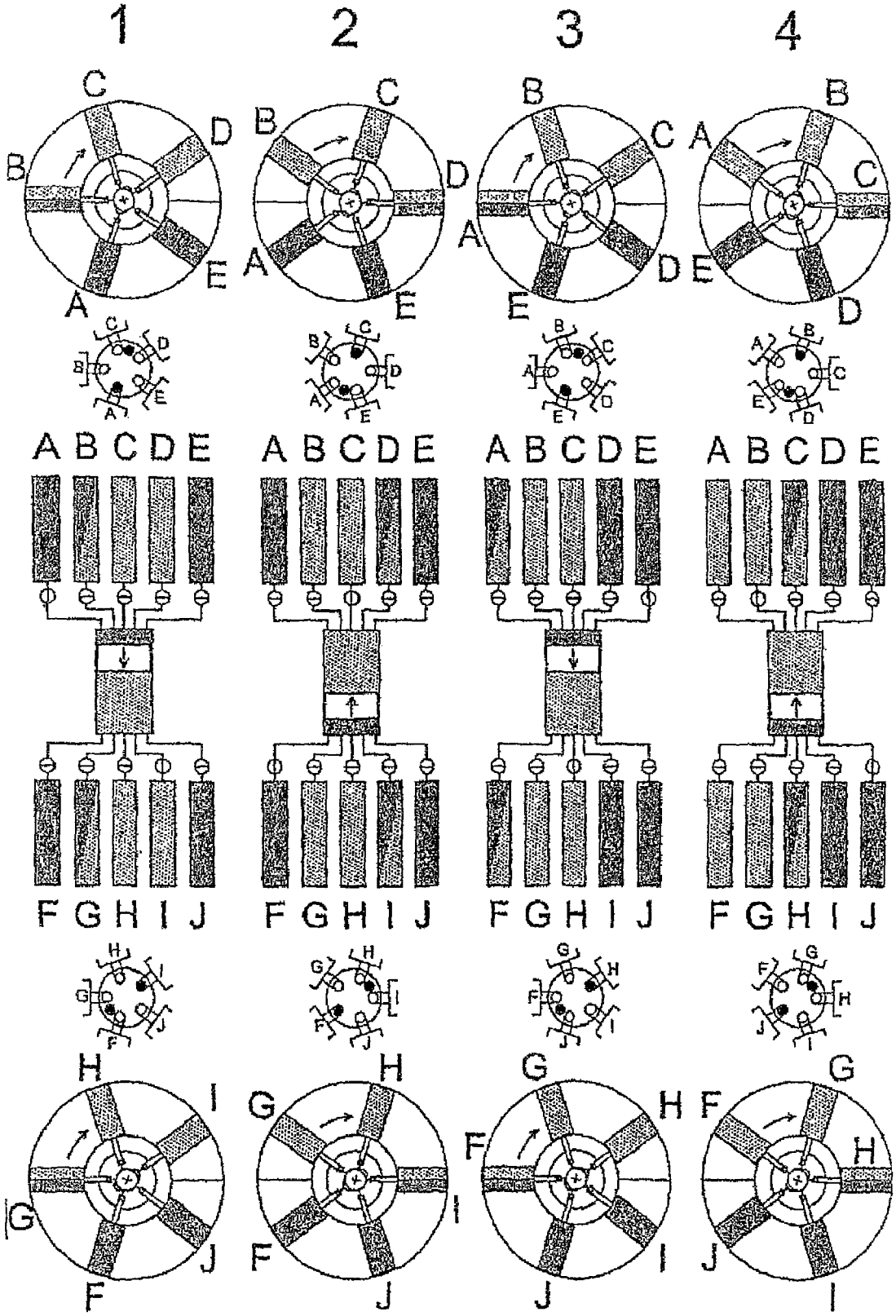
Figure 13C:
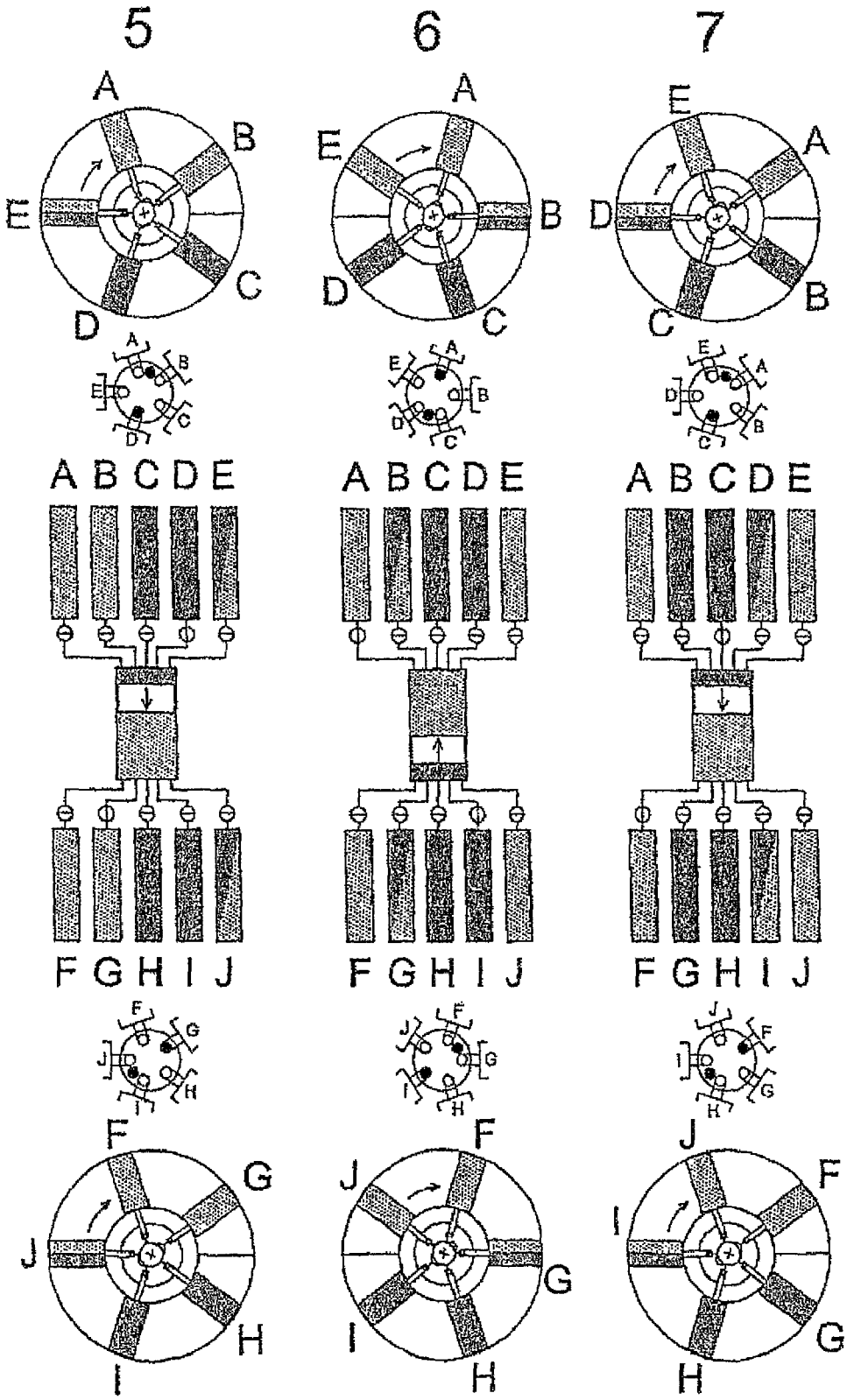

Third Variation of the Basic Module (See FIG. 5 and FIG. 13)

It is apparent, to arrange heat exchangers 1, connecting pipes 4 and valves 5 symmetrically on both sides of the working cylinder 2, instead of pressure balancing tank 9 described before.

In this case, the succession of the valve 5 operation on both sides of the piston 3 is co-ordinated in such a manner, to allow expansion at one side of the piston 3 and compression at the other side simultaneously.

The process of such a double acting aggregate is illustrated in FIG. 13, but with 5 heat exchangers on each side of the working cylinder 2.

Figure 6:
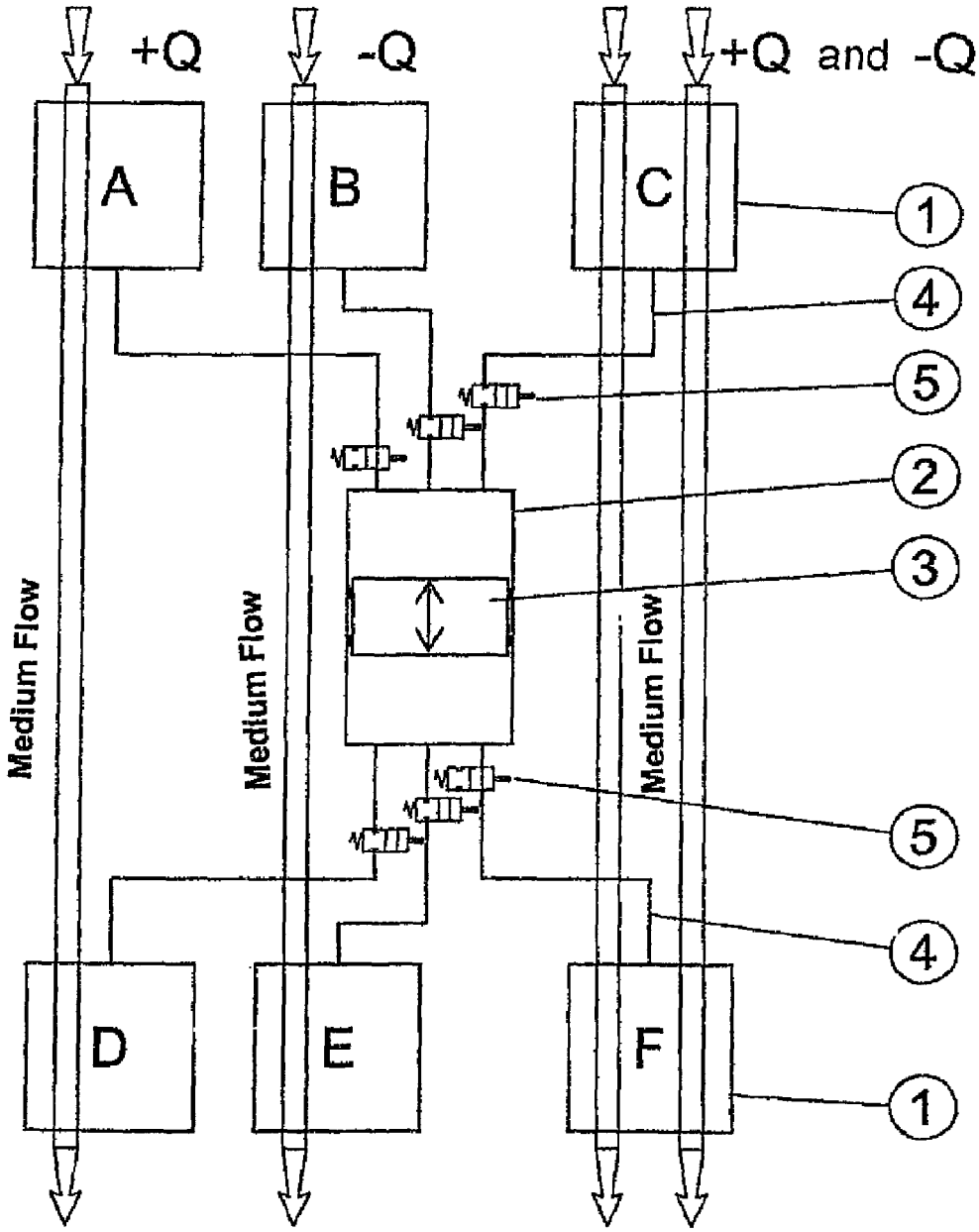
FIG. 6 a schematic diagram as shown in FIG. 5, with the simultaneous medium flow, through oppositely arranged heat exchangers 1.
Figure 7:
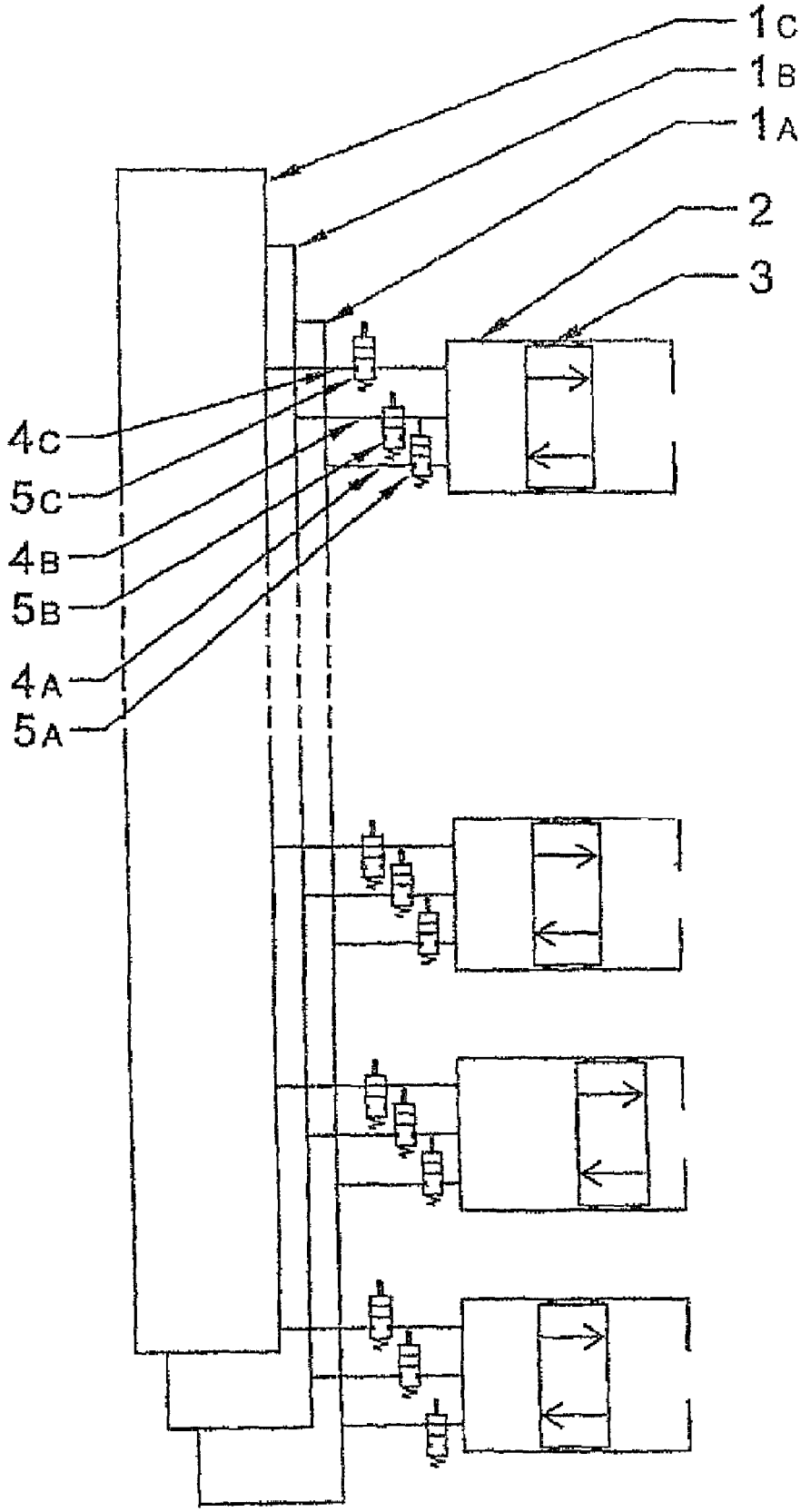
FIG. 7 a schematic drawing of the invention, where several modules, consisting of connecting tubes 4, valves 5, working cylinder 2 and working piston 3 are attached to certain heat exchangers 1.

Fourth Variation of the Basic Module (See FIG. 6 and FIG. 13)

This variation mainly corresponds to the third variation with the difference, that heat exchangers 1, which are attached to the rear side of the working cylinder 2 are situated directly in-line behind those at the front side, allowing the heating cooling medium to pass the heat exchangers 1 on the front side as well as those at the rear side. In doing so, the heating and cooling medium will always simultaneously pass through successively positioned heat exchangers 1. (FIG. 13)

Figure 14A:
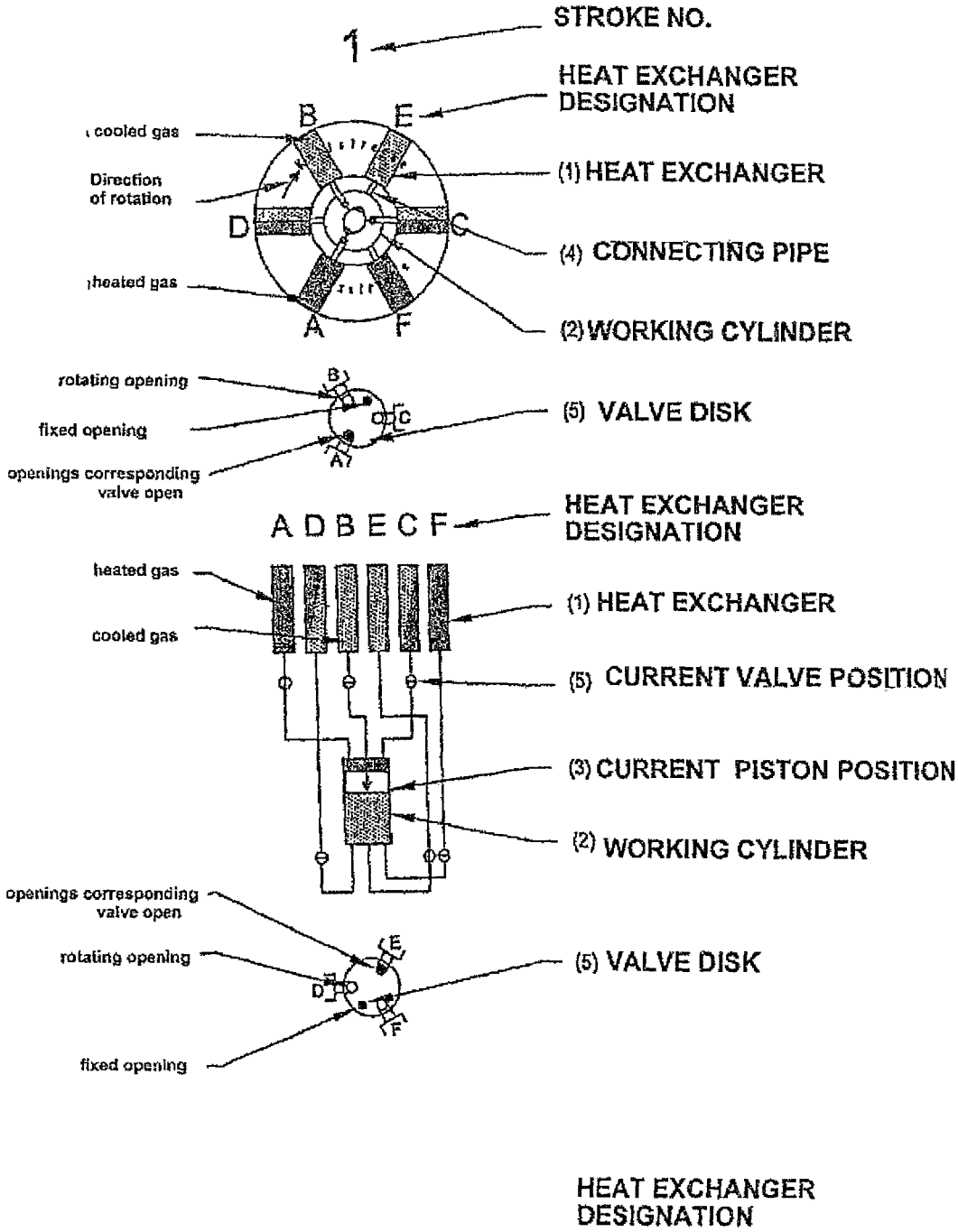
FIG. 14A "Symbols Description" and the pertaining FIG. 14B "diagram of stroke 1 to stroke 4" and 14C "diagram stroke 5 to stroke 7", a schematic diagram of the process, where all heat exchangers 1 are arranged in a star shaped manner around the centre line, but alternately attached to one or the other side of the working cylinder 2.
Figure 14B:
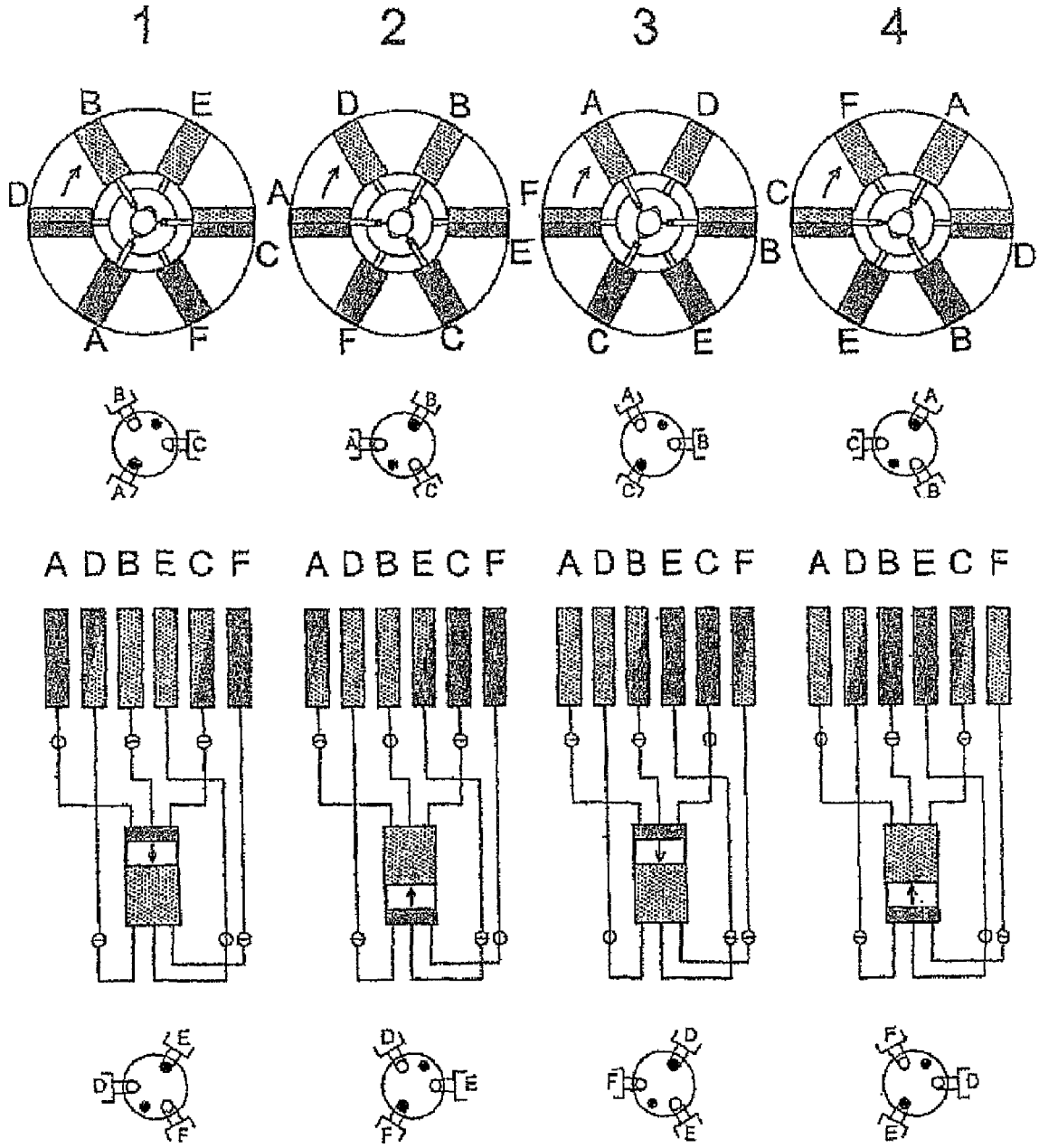
Figure 14C:
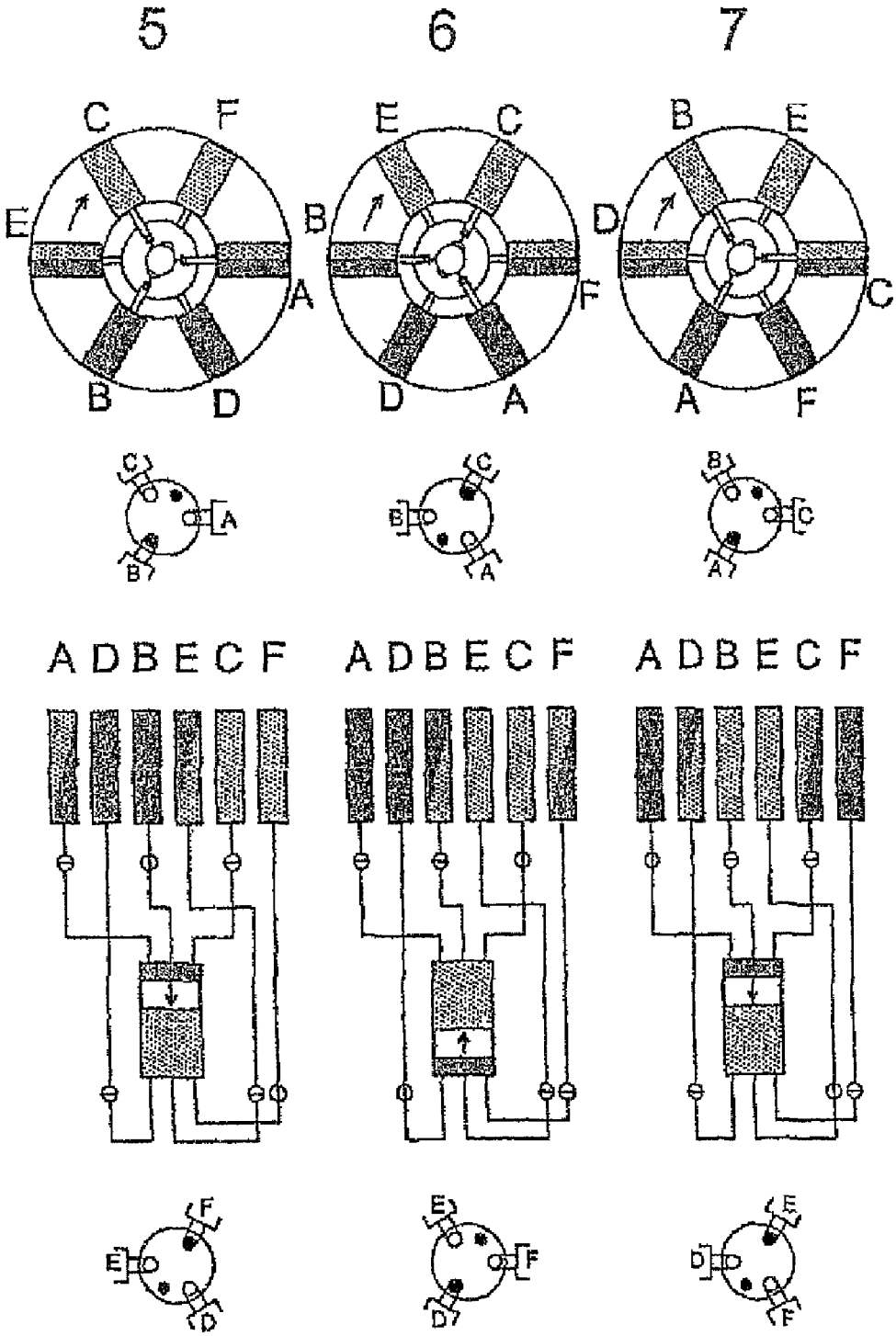

Fifth Variation of the Basic Module (See FIGS. 10 and 14)

With regard to the working cylinder 2 and piston 3, including the connections 4 of the heat exchangers 1, this variation corresponds to those of variations three and four. In this variation all heat exchangers 1, are arranged in a star shaped manner around the working cylinder 2. A valve actuator 6 is required on each side of the working cylinder 2. The heat exchangers 1 alternately are attached to the front, and the rear side of the working cylinder 2. If half of the total sum of all heat exchangers 1 equals an odd number, with each angle of rotation of the rotor, one heat exchanger 1 always is connected to one side of the working cylinder 2 and another heat exchanger 1 is connected to the opposite side of the working cylinder 2. As shown in FIG. 14, valves 5 always will connect heat exchangers 1 with different conditions of the working gas to the working cylinder 2. The process occurs as shown in FIG. 14.

Sixth Variation of the Basic Module (See FIG. 11)

It requires substantially more energy, to alternately heat and coot the heat exchanger 1 itself, the actual container of the working gas, than to heat or cool the working gas itself. Therefore a lot of energy is lost, which actually should be recovered. To reduce this energy wastage, a regenerator for a module, as described in the fifth variation, is required.

The regenerator is a circulation system, with which the heat of the heated heat exchangers 1 is utilized by circulating the cooling/heating medium to heat the cooled heat exchangers 1 and simultaneously to be cooled itself by the medium that has been cooled by heat exchangers 1 which have passed through the cooling media.

In case of gaseous heating/cooling media, the regenerator consists of a fan 10 or in case of liquid media of a pump 10 and re-circulation ducts or pipes 11 that return the media from one segment of the rotor that passed the heating section, to another section that passed the cooling section, and back again.

Figure 15:
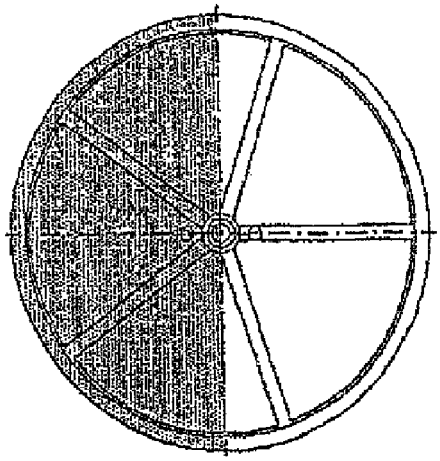
FIG. 15 a schematic diagram of the basic module, with a heat exchanger 1 shaped as radiation absorber, whereas a possible construction of the shade elements and the cladding of the radiated absorber surface are schematically shown.
Figure 15:
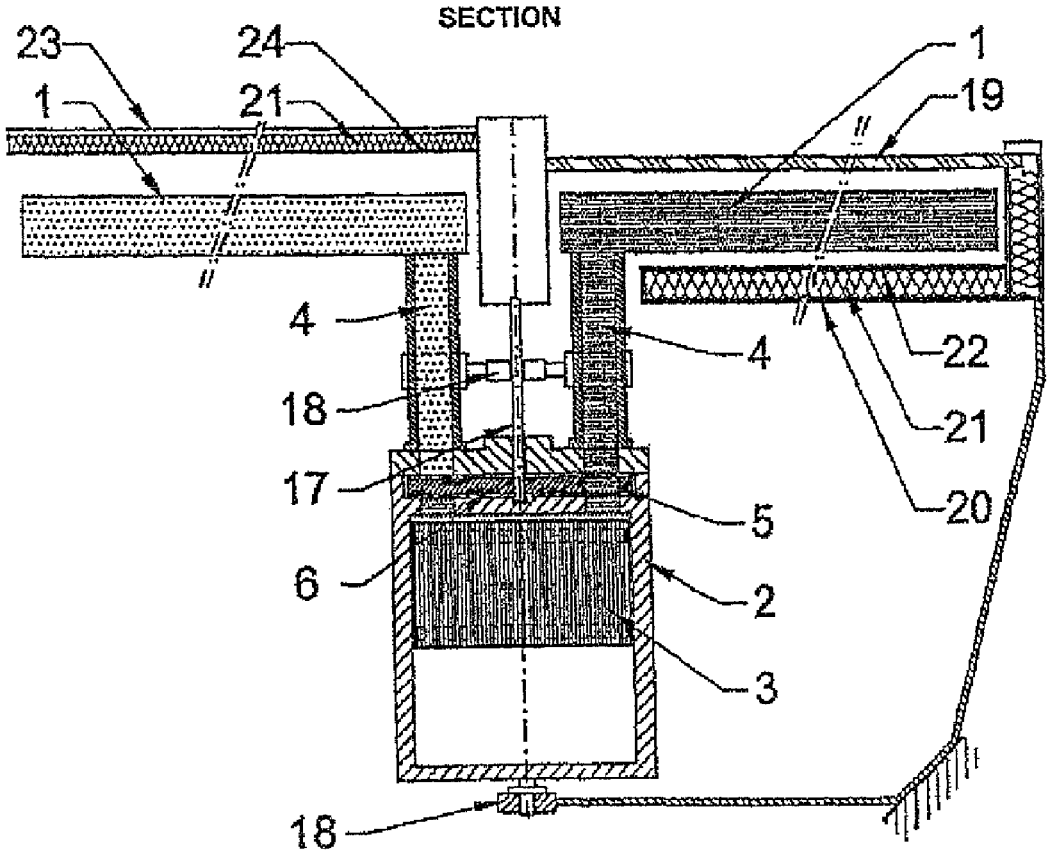

Seventh Variation of the Basic Module with Radiation Energy as Primary Energy (see FIG. 15)

The principle of the basic module is maintained. Instead of the ducts for heating and cooling media, the heat exchangers 1 are designed as radiation absorbers. The function of working cylinders 2, pistons 3 and valves 5, as described in the basic module, remains unchanged.

The heat exchangers 1 (as absorbers) are aligned in such a manner, that the available radiant heat can be optimally absorbed. They are flat shaped and coated with an absorbing coating. Since the absorbed heat must be transferred to the environment again, a construction is provided, which permits an optimal convection.

Similar to the basic module, only half of the absorbing surface of the heat exchangers 1 is exposed to radiation. The other half is shadowed.

Half of the heat exchangers 1, which are exposed to radiation, should absorb heat as much as possible and should thus be protected against loss by convection. The heat exchangers 1 with working cylinders 2, connecting tubes 4 and valves 5 rotate around the longitudinal axis of the working cylinder 2 as described in the basic module. By doing so, the heat exchangers 1 are heated alternately by radiation and cooled again, by emitting heat to the environment. As described for the basic module, valves 5 are actuated in such a manner, that alternately a cooled and heated heat exchanger 1 is connected with the working cylinder 2, in order to perform work by expansion or compression.

Eighth Variation of the Basic Module with Radiation Energy as Primary Energy (See FIGS. 14 and 15)

Heat engines, as described in variation seven with the variation that half of the heat exchangers 1 are attached to one side, the other half is attached to the other side of the working cylinder 2. The heat exchangers 1 are all on the same side of the working cylinder 2 and are arranged in a star shaped manner around the cylinder forming the shape of a disk. The process sequence corresponds to that described in variation five and illustrated in FIG. 14.

Ninth Variation of the Basic Module

The Clausius Rankine Cycle

Because of the substantially larger quantity of energy, which is required to heat up or cool down the heat exchanger the actual container of the working fluid, in comparison to the working fluid itself latent heat of vaporization is used, which represents a multiple of the thermal capacity of the working fluid. Condensing or evaporating the working fluid at the wall of the heat exchanger requires a substantially larger amount of energy flow than only heating or cooling the working fluid.

The possibility exists to carry the condensate, which has a substantially smaller specific volume than the gaseous aggregate, from the cold zone into the warm zone (comparative with the Clausius-Rankine cycle, where the condensate is pumped into the high pressure zone.). In the high pressure zone, the increase of volume caused by evaporation is used, to perform work.

In order to integrate the Clausius-Rankine cycle into the already described Stirling cycle, some modifications have to be made to the heat exchangers 1. Each individual heat exchanger 1 is divided into two halves (see FIG. 12). In the centre, the two halves are connected with an intermediate insulating layer. The insulating layer provides a thermal decoupling of the two halves, so that the heat will not be transferred from one half to the other, by means of the metallic walls of the heat exchanger.

As described in variation six, the heat exchangers 1 are arranged in a star shaped manner around the working cylinder 2 and are alternately connected to the front and rear side of the working cylinder 2. Also in this variation, the heat exchangers 1 rotate together with the working cylinder 2 around the longitudinal axis and form therefore a so called rotor. Exactly as described in the sixth variation, on each side alternately compressions and expansions are released by means of the valve actuators 6. Simultaneously an expansion will take place at the rear and a compression at the front of the cylinder, or vice versa.

The divided heat exchangers 1 used in this variation, are built in such a manner, that the outer half of the separate heat exchangers 1 are exposed to the cold medium while the inner halve (that are closer to the working cylinder 2) are exposed to the heating medium. In the space between the separate heat exchangers 1, a cylindrical divider 12 is positioned, with which the heating medium is separated from the cooling medium, within the rotor. Outside of the the heat exchangers 1 as well as on the inside (between heat exchangers 1 and working cylinder 2) there are concentrically arranged "pipes" 13 and 14, which together with the cylindrical partition 12, in the middle of the heat exchangers, define two annulus ducts, each containing the "cooled" and "heated" halves of the heat exchanger respectively. In the drawing these pipes are called the external 13 and internal 14 cover.

Additionally, each individual heat exchanger 1 is separated from the neighbouring heat exchangers 1 by a segregation partition 15, which extends from the external cover 13 to the internal cover 14. With the aid of these segregation partitions 15, the heating and cooling media are channelled through the rotor. Between two segregation partitions 15, there is just one heat exchanger 1 in each segment.

Ducts carrying the heating or cooling media are attached to both faces of the rotor. The ducts with the heating medium are attached to the upper semi-circle of the internal annulus shaped channel, the cooling medium pipes are attached to the lower semi-circle of the outside annulus channel. Only half of the respective annuli are connected to heating or cooling medium, since the heating and cooling takes place alternately.

The cooling process starts after closing valve 5 at the end of the expansion phase within the heating zone. The heating process starts after closing valve 5 at the end of the compression phase within the cooling zone.

The working fluid, in the closed heat exchanger 1 condenses on the surface of the heat exchanger wall, which has a temperature below dew point of the working fluid. Condensation will prevail until the pressure within the closed heat exchanger 1 corresponds with the vapour pressure of the working fluid. In this case, the entire wall of the "cooled" half of the heat exchanger will have this temperature, because the cooling medium of this half of the heat exchanger 1 constantly extracts the condensation heat.

Since the heated half of the heat exchanger 1 is communicatingly connected with the cooled half, the condensate in this part would evaporate, if it could flow thereto. Since the (previously) heated part of the heat exchanger 1 is positioned, during the cooling process, above the cooled half, it is physically not possible.

With the heated part of the heat exchanger 1, this is different. If the working fluid evaporates with constant heat supply, vapour will condense again, due to the communicating connection to the cooled part (described before). This procedure will continue, until the wall of the heat exchanger (now without extraction of heat) reaches the vapour pressure temperature of the working fluid. To avoid this, three possibilities are considered:

1. The connection(s) of the opening between heated and cooled halves is (are) mechanically closed.
2. There is a kind of regeneration, similar as already described in the "sixth variation", where the cooling/heating medium between the heated section of the inside annulus, which follows directly after closing of the "expansion valve" 5, is exchanged by fan 10 or pump 10, with the cooled section, which follows directly the "compression valve" 5. Thereby the heat of the heated part of the heat exchanger wall can be used to heat up the cooled heat exchanger wall. Depending on the efficiency of this regeneration the quantity of the condensing working fluid can be reduced.
3. A combination of the two aforementioned methods.

Figure 12:
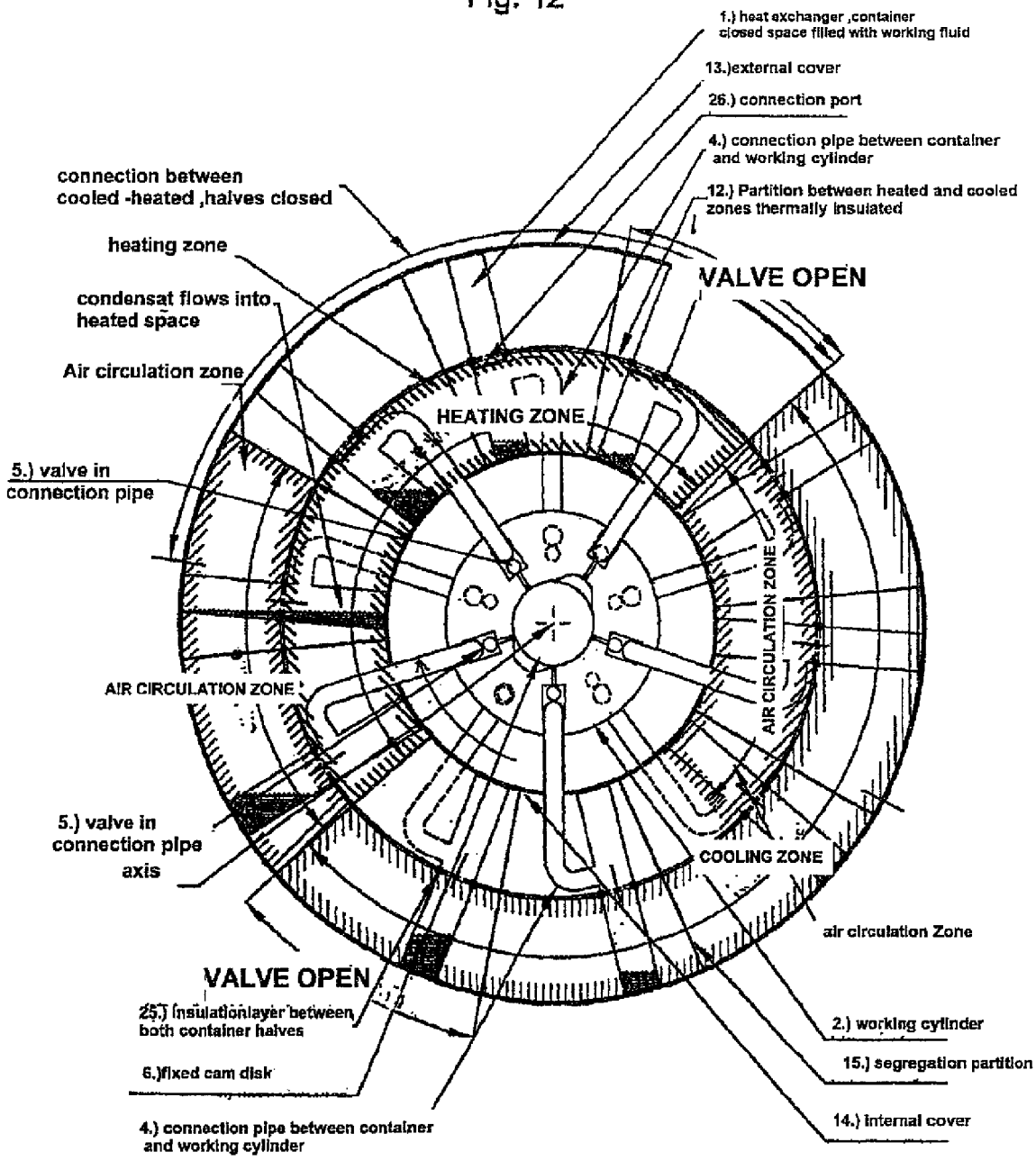
FIG. 12 a schematic drawing of the rotor with the combined Stirling-Clausius-Rankine cycle, with 10 heat exchangers 1, which are arranged in a star shaped manner around the working cylinder 2. Half of the heat exchangers 1 are attached to the front side and the other half are attached to the rear side of the working cylinder 2. The heating, cooling and regeneration sections (circulating air) are identified.
Figure 16:
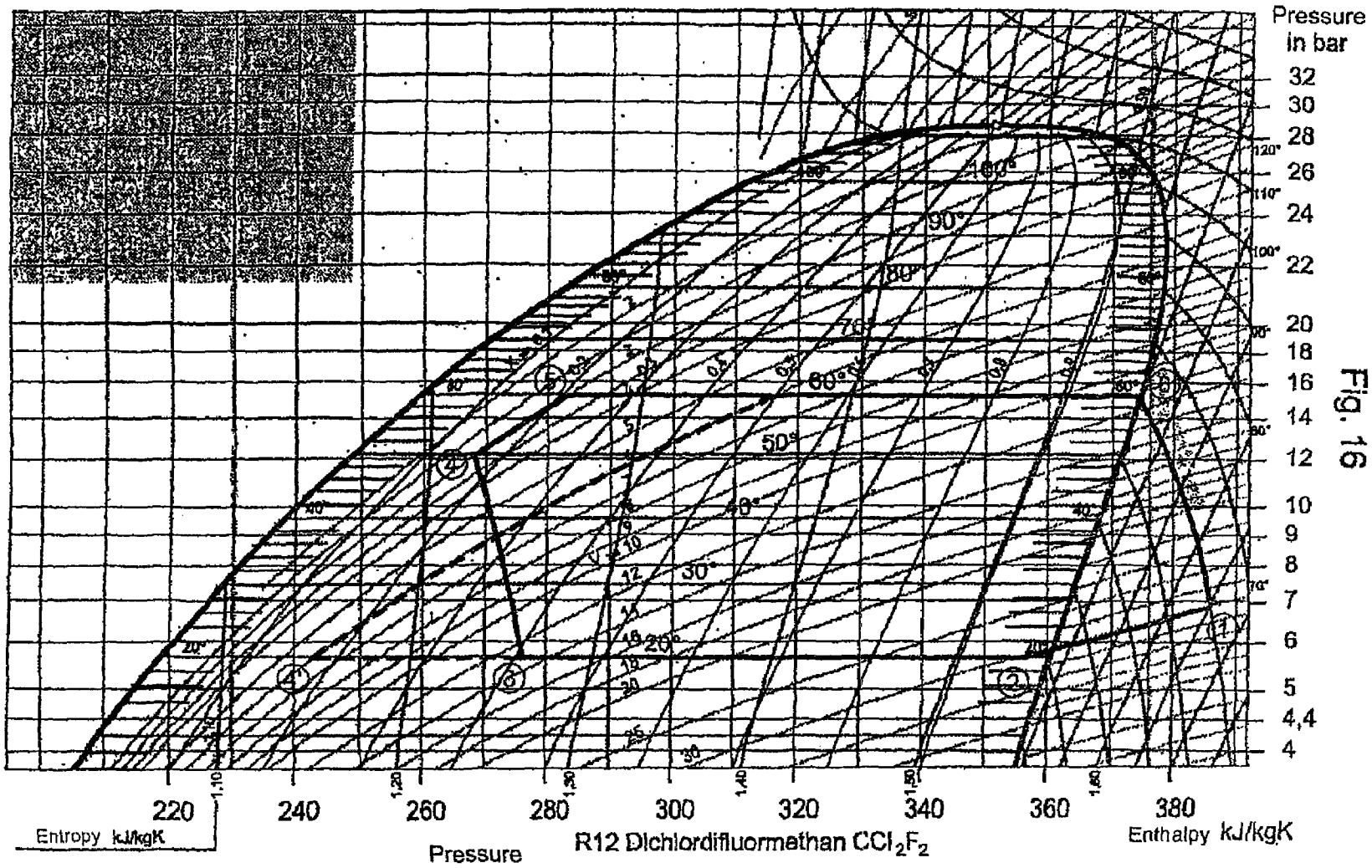
FIG. 16 a pressure enthalpy diagram with $CCl_2Fl_2$, Freon R12 as working fluid.

Considering the described design features the Clausius-Rankine cycle can now be explained. Refer to FIG. 12 "Design features of the Stirling Clausius Rankine heat engine" and FIG. 16 to 18 "Thermodynamic comparative cycles of the Stirling-Clausius-Rankine heat engine". Dichlorodifluoromethane ($Cl_2Fl_2CH$), Frigen R12 was used for this example as working fluid. The reference temperatures for this example are selected to be 60° C. as the upper temperature level and 20° C. as the lower temperature level.

Due to rotation of the rotor, the outer cooled half of a heat exchanger 1 is located at times underneath, at times above the heated half. It therefore makes sense to select the cooling zone such, that during the cooling procedure the cooled half of the heat exchangers 1 is located at the bottom. The formed condensate is collected in the lower and hence outer region of the heat exchanger 1. Due to rotation, the cooled half moves to the top of the heated half. At a certain position the condensate will flow from the cooled into the heated half. (This procedure replaces the feed pump in the classical Clausius-Rankine process). The largest mass of the working medium is now located on the heated side of the heat exchanger 1. The evaporation process begins. In order to avoid simultaneous condensation on the cooled half of the heat exchanger, the connection ports between the heated and cooled halves are mechanically closed.

To illustrate the sequence of the cycle with reference to FIG. 12 of the drawing the process starts with the isochoric cooling. Directly after closing the expansion valve 5, the heat exchanger 1 in question is located in the cooling zone. Heat is constantly extracted from the heat exchanger 1 in this zone. The working medium is condensing until vapour pressure (of the working fluid) has reached the temperature of the cooling medium. Since valve 5 is closed during this procedure, the total volume stays constant within the heat exchanger 1.

Figure 17:
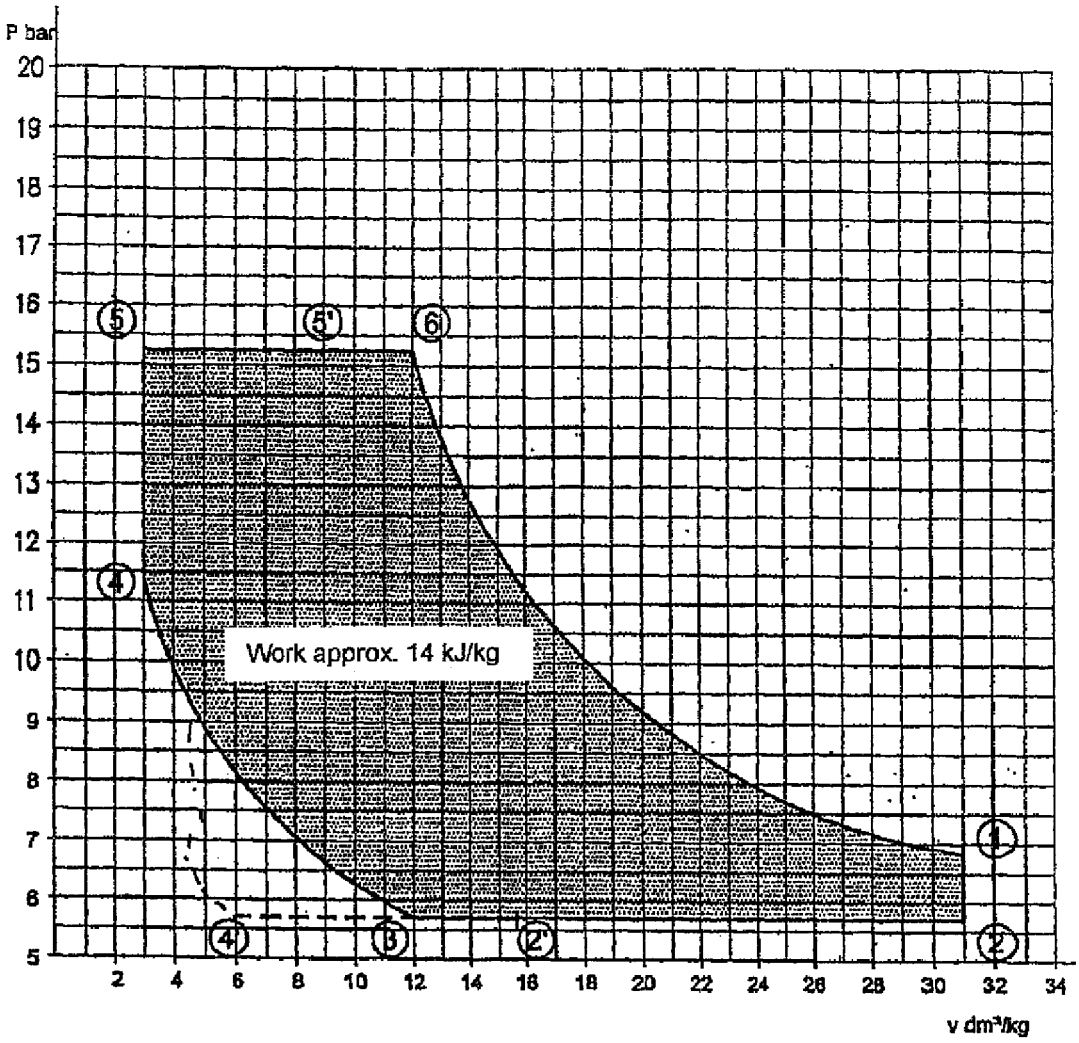
FIG. 17 P-v-diagram related to the P-h-diagram described in FIG. 16.
Figure 18:
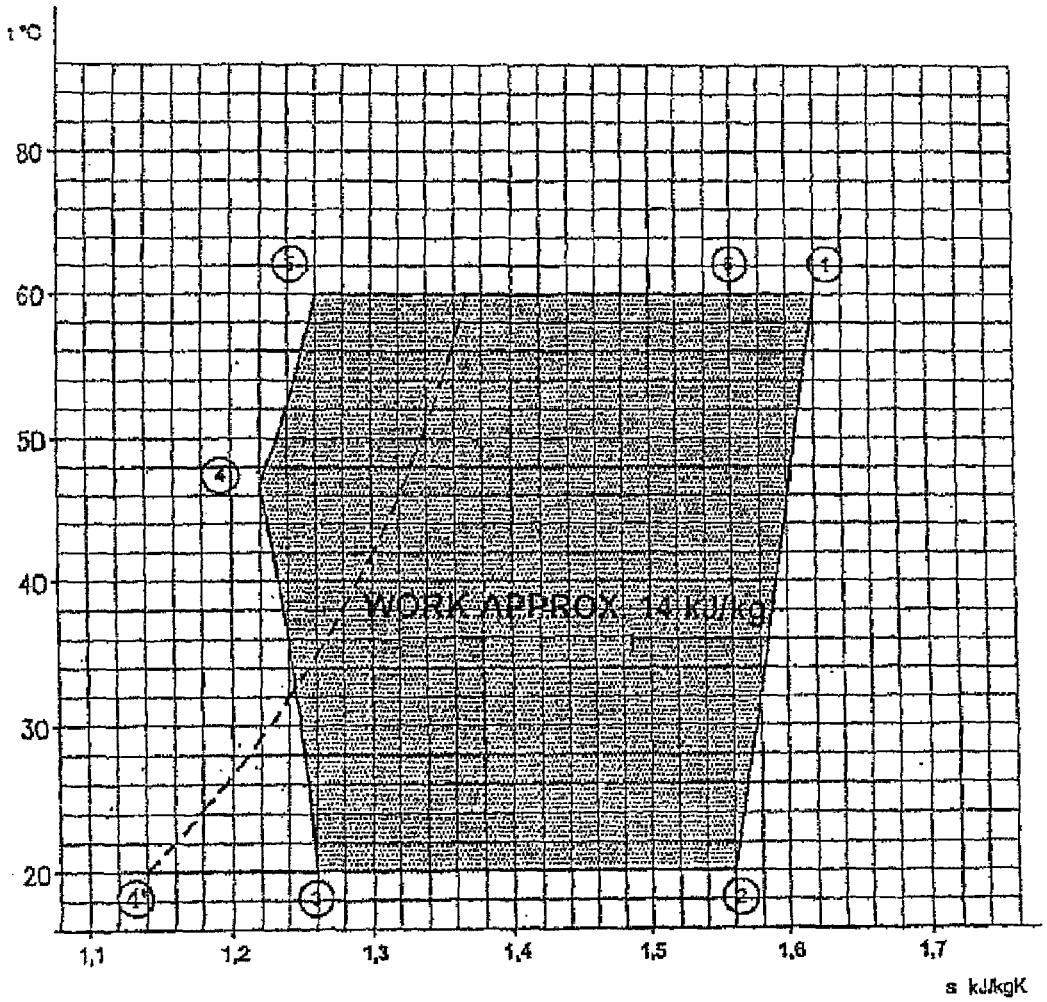
FIG. 18 T-s-diagram related to the P-h-diagram described in FIG. 16.
Figure 19:
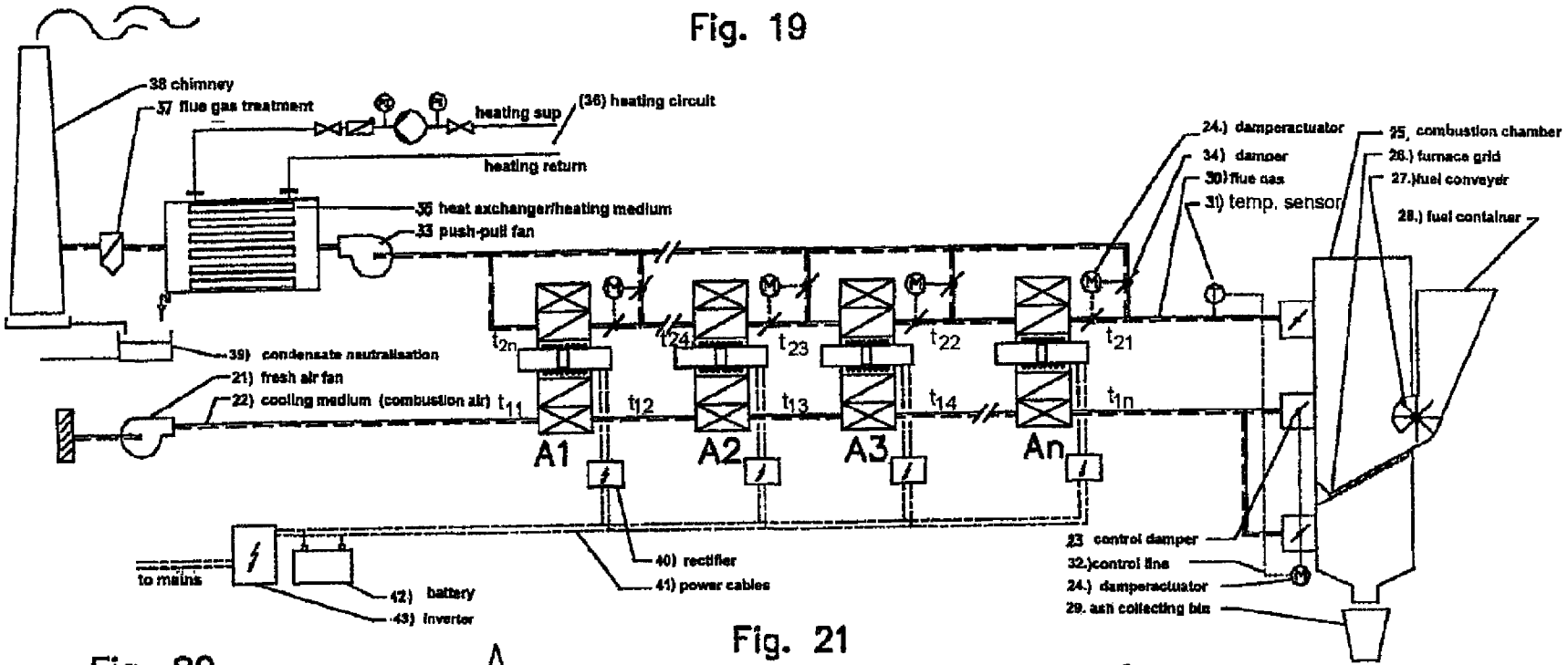
FIG. 19 possible construction of the invented CHP plant, schematically illustrated FIG. 20 heat engine as described in detail below and schematically illustrated in FIGS. 1 to 18.

Due to rotation the point, at which the valve 5 opens toward the working cylinder 2, is reached. Valve 5 now opens and connects the space in the heat exchanger 1 with that of the working cylinder 2. Because of negative pressure in the heat exchanger 1 and because the expansion of the simultaneous process on the other side of the working piston 3 the working gas flows from the working cylinder 2 into the heat exchanger 1. During this procedure and during the time after closing the (compression) valve 5, the working fluid condenses until vapour pressure corresponding to the temperature is reached. (FIG. 17. point 2 to point 3). During compression of the working gas, heat is constantly extracted from the heat exchanger 1, by the cooling medium. An isothermal compression is taking place. (FIG. 17. point 3 to point 4). This change of state belongs as well to the Stirling cycle described before as to the Clausius-Rankine cycle described here. By the isothermal and non-isentropic compression of the working gas, the herein described Clausius-Rankine cycle deviates from the classical cycle.

With a closed valve 5, heat is constantly supplied to the heat exchanger 1 (FIG. 17. point 4 to point 5).

Due to rotation of the rotor the point is reached, where the cooled half of the heat exchanger 1 moves over the heated half and the condensate of the working fluid flows into the heated half. The connection ports between the cooled and heated halves are mechanically closed. While heat is constantly supplied through the heating medium in the heated half, the condensate evaporates. The evaporation is taking place until the vapour pressure of the working fluid has been reached, now at the upper temperature level, (FIG. 17, point 5 to point 5').

With further rotation, the point is reached, where valve 5 opens toward the working cylinder 2 for the second time during the cycle. Valve 5 opens and now connects the space within heat exchanger 1 with that of working cylinder 2. The positive pressure in heat exchanger 1 and the compression taking place simultaneously on the other side of working piston 3, force the gaseous working fluid out of the heat exchanger 1 into the working cylinder 2. During this expansion procedure, heat is constantly supplied to the heat exchanger 1 by the heating medium. Initially the evaporation process is continued, then followed by an isothermal expansion. This change of state belongs as well to the previously described Stirling cycle as to the Clausius-Rankine cycle, described herein. By isothermal and non-isentropic expansion of the working gas, the Clausius-Rankine cycle, described herein, also differs from the classical cycle.

The connection between the heated and the cooled halves is again mechanically opened.

After closure of valve 5, the process starts from the beginning.

Tenth Variation of the Basic Module

A heat engine, as described in the ninth variation, with the difference that the heated part of the heat exchanger 1 is designed as an absorber for radiation energy, instead of a heat exchanger. The cooled part can be designed for any form of heat transfer, e.g. free convection, water cooling, heat exchanger for gaseous or liquid cooling media etc. Working cylinders 2, piston 3, connecting pipes 4, valve 5, valve actuators 6 etc. have the same function as described in the ninth variation, together with the heat exchangers 1 they rotate around a common axis. In this variation, the connections between the heated and cooled part of heat exchangers 1 are closed during the heating process.

According to the description in the seventh variation, the absorbing surface of the heat exchanger 1, which is exposed to radiation, is protected against convection losses. For this purpose a glass covering 19 at the front side and an enclosure 20 to 22 with reflecting surface towards the absorber behind, is provided. The cooled part of heat exchanger 1 is shaded against radiation energy, in an analogue manner as described in the seventh variation.

Eleventh Variation

In this variation a rotor with heat exchangers 1, connecting pipes 4, valves 5 and valve actuator 6 are utilized as described in the ninth variation, but without working cylinder 2 and piston 3. That is why only one not two valve actuators 6 is required, (which are arranged on both sides of the working cylinder 2) but compression and expansion of all heat exchangers 1 take place at the same valve actuators 6.

Instead of the working piston 3 a rotating machine is utilized, e.g. a rotary-piston engine, reversed rotary screw compressor, reversed multiple cell compressor, turbine or similar, where expanding working gas can expand. Since the valves 5 of the described rotor, consisting of heat exchanger 1, connecting pipes 4, working cylinder 2 etc. always opens at the same place for an expansion, the expanding working gas is introduced to a fixed pipe by means of a suitable valve construction. This introduces the working gas into the high pressure side of the rotating machine. For the compression, the working gas can be carried back to the heat exchangers 1, again in an analogue manner, by means of a pipe running from the low pressure side of the rotating machine up to the place, where valves 5 open for compression procedure. With such a machine a rotating shaft is available, which can propel a power generator or any other machine.

The rotating motion can also be used to propel the rotor of the heat exchanger. By carefully tuning the rotating speeds of rotor and rotary machine, a correct quantity of available working gas for the rotary machine is guaranteed.

An isentropic expansion takes place at this variation, therefore it provides a smaller thermodynamic efficiency in relation to the other variations.

Deviations of this Invention from the State of Art

The heat engine of this invention is operated with an external heat source, therefore it differs from all heat engines with internal combustion.

In a variation of this heat engine the Stirling cycle is combined with a Clausius-Rankine cycle, with 6 changes of state. Thus this invention differs from conventional machines, which run either with a Stirling cycle only or with a Clausius-Rankine cycle only.

The most substantial difference to the conventional technologies exists in the interaction of different cycles on one combined working cylinder 2. With a completed cycle of this heat engine, the working gas or working fluid has passed within each individual heat exchanger 1 through a complete Stirling cycle with four changes of state or a complete Stirling-Clausius-Rankine cycle with 6 changes of state, i.e. within the individual heat exchangers 1 and combined working cylinder 2. Each valve 5 has opened and closed twice, which means that each heat exchanger 1 experienced one expansion and one compression in one revolution of the rotor.

Involved is a heat engine, which in comparison to other heat engines, comprises a few moving parts, requires little dead space and has very few internal losses. The movable parts are a free moving working piston 3 inside a working cylinder 2 and a rotary rotor consisting of: heat exchanger 1, connecting pipes 4, valves 5, internal 14 and external 13 covers and segregation partitions 15.

By using the valves 5 this invention differs from the classical Stirling engine. That is why the changes of state can be nearly completely used. By a careful design of the components, the actual efficiency achieved can very closely reach the theoretically possible efficiency. The valve 5 is only opened after the heating or cooling process has been completed. The working gas 2 is able to expand into the working cylinder or compress from the working cylinder 2 on the shortest route.

One difference of this heat engine to conventional heat power plants is the fact that in conventional plants the working gas or working fluid, e.g. in steam power plants, moves from the warm heat exchanger 1 to cold heat exchanger 1 and back again, however, in this heat engine the largest part of the working gas remains in the same heat exchanger 1 to alternately be heated or cooled.

Piston 3 of this free moving piston machine is magnetized by permanent magnets 7 or electrical exciting current and runs in a non-metallic working cylinder 2, around which an electrical coil 8 is mounted. Thereby the mechanical work is converted without detours, directly into electric power. Apart from the friction losses of the free moving piston 3, no further mechanical losses arise during the generation of power.

Organic compounds, e.g. ammonia and refrigerants, which are used in heat engines, e.g. ORC plants, can also be meaningfully used in the same manner in this invention by changes of state of aggregation. This heat engine differs from the conventional ORC plant by the fact that condensation and evaporation takes place alternately, within one heat exchanger 1.

Although this invention refers to a heat engine of a type as described above the invention specifically refers to a power plant with heat transfer as described below.

A possible build-up of a combined heat and power plant in accordance with the invention is illustrated in FIG. 10 of the drawings. Here a suitable number of heat engines A, e.g. A1, A2, A3, . . . An are arranged in series. Air 22 provided for combustion is passing as a cooling medium the cooled part of the different heat engines A1, A2, A3, . . . An successively and after leaving the last heat engine An is directed as combustion air to a combustion process in the combustion chamber 25.

Figure 21:
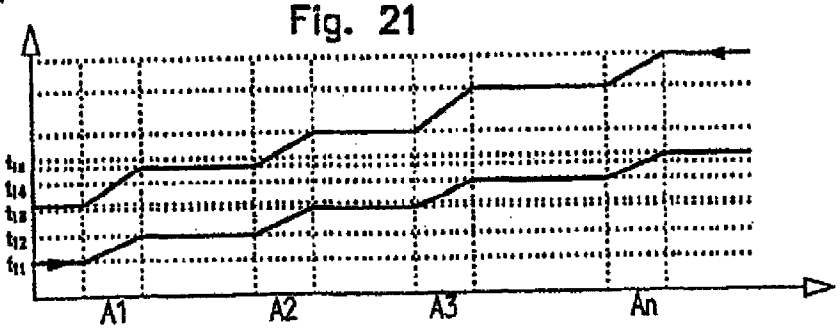
FIG. 21 diagram, illustrating the approximate temperature profile of the cooling and heating media

The flue gasses 30 from the combustion process in combustion chamber 25 is passing through the heated zone of the different heat engines. An . . . A2, A1 in opposite direction and reversed sequence as a cooling medium 22, whereas a similar temperature difference, however, with a different temperature at each heat engine as roughly illustrated in diagram, FIG. 21 of the drawing. The working fluid of each heat engine A is selected so as to be adapted to the occurring temperatures.

The fuel is stored in a fuel container 26. The fuel container 26 can be suitable for solid fuel (e.g. chipped wood) as a funnel or for liquid fuel or gas designed as a tank. The fuel is transported by means of a conveyer 27 (rotary valves or screw conveyor) with solid fuel into combustion chamber 25. For solid fuels a combustion grating 28 is provided, that is constructed in such a manner, that the fuel is optimally distributed on the surface of the grating.

The cooling and combustion air could be clean ambient air or cooled air or air originating from other processes that is suitable for combustion air for the fuel used. It is boosted with a fan through each heat exchanger 1 of the separate heat exchangers A into the combustion chamber.

While passing through heat exchanger 1 of each of the different heat engines A the temperature of the air rises due to the heat gain from the heat exchangers.

The heated air will be used, after leaving heat exchanger 1 of the last heat engine An as combustion air. Part of the cooling air will by the use of dampers be directed partly into the combustion chamber 25 and partly bypassing it. After the combustion both air streams are combined and mixed. The dampers 23 are controlled by a temperature control circuit, comprising a temperature sensor 31, controller and actuating motor 24, in such a manner that a constant temperature of the combustion gas 30 is achieved. The combustion gas 30 will subsequently be identified as a heating medium.

The heating medium 30 will now be directed into heat exchanger 1 of heat engine An, through which the cooling medium finally passed. Subsequently the heating medium wilt pass through all other heat engines A in a reversed sequence and direction as the cooling medium. By dissipation of heat to the heat exchangers 1 the temperature is reduced in each heat exchanger 1. As the temperature decreases in opposite direction as the temperature of the cooling air rises, more or less the same temperature difference will occur in each heat engine A, which is required for converting heat into work.

The leaving temperature of the heating medium is dependent on the chosen number of heat engines A, the working fluids, especially in the last stages and the design of the heat engines A. It can be similar to a condensing boiler approximately 50° C. This means that the latent heat of evaporated water in the combustion flue gas 30 also contributes to the power generation. The higher calorific value of the fuel will be exploited. Also the latent heat used to evaporate water in moist fuels is not lost.

For the produced condensate out of heat engine A a neutralisation device 39 is be provided.

To utilize the remaining heat in the flue gas after leaving the last heat engine A1 for heating purposes it will be directed into a heat exchanger 35. Water for district heating will be circulated through the secondary side of the heat exchanger. Should more heat be required for heating purposes as the available remaining heat in the flue gas 30 after the last heat engine A1, then the last heat engine can be stopped to allow the heat to pass unused through it. Should this not be sufficient for the heat load the second last heat engine can be stopped. This can be continued until the heat engine An is stopped and the total heat is used for heating purposes.

The vapour pressure of the working fluid, specially in the first heat engines, through which the flue gases pass, can rise at the high temperatures sufficiently to damage the construction of the heat exchanger 1, therefore when the heat engine is stopped the flue gasses are not passing the heat exchanger but bypass the heat engine, with the aid of bypass dampers with motor 34, and feed directly into the heat exchanger 35. Bypass dampers with motor 34 are located in front of each heat engine A, whereas the flue gases are diverted past the following heat engines to be used for different purposes. The flue gases will finally directed to a chimney 38. As far as required a flue gas cleaning plant can be provided between the CHP and the chimney 38.

Figure 20:
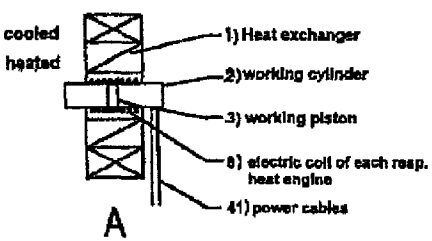

The individual heat engines A—refer to FIG. 20, are equipped with a magnetized piston 3 and their cylinders 2 are fitted with an electrical coil 8, that electric power can be induced with piston 3. Thereby each engine A produces a type of alternating current, each with a different frequency. This current will be rectified into direct current by a rectifier 40 and will be stored in batteries 42, whereas simultaneously the direct current is converted into alternating current at mains frequency by an inverter 43. For each machine A a separate power cable 41 is provided.

As the above described heat engine A is designed in different variations different variations of heat engines A can be used in this kind of CHP. Therefore it would be advantageous when at very high temperature heat engines are employed that operate with a Stirling cycle and at lower temperatures heat engines with combined Stirling-Clausius-Rankine cycles are used.

The invention claimed is:

1. Heat engine, which by means of four changes of states, namely 1) isochoric heat supply
2) isothermal expansion
3) isochoric heat dissipation
4) isothermal compression of an enclosed working gas between two temperature levels performs work, and features the following: at least three heat exchangers (1A, 1B and 1C), which comprises only one connection each, one connecting pipe (4A, 4B and 4C) to a working cylinder (2) and where each connection is equipped with a valve (5A, 5B or 5C) and the heat exchangers (1A, 1B and 1C) alternately are enclosed by a heating and a cooling medium flow.

2. Heat engine according to claim 1, wherein the heat exchangers (1A, 1B and 1C), connecting pipes (4A, 4B and 4C) and the working cylinder (2) are filled with a working gas and a free moving piston (3) located in the working cylinder (2), which performs work by expansion and compression of the working gas.

3. Heat engine according to claim 2, wherein the working gas is heated up in the first heat exchanger (1A) by means of an external source to the upper temperature level and by opening the associated first valve (5A) the gas is able to expand into the working cylinder (2) during continuous heat supply and is performing work in there, wherein after exclusion of the expansion procedure the same valve (5A) closes again and by the external source the first heat exchangers (1A) is cooled down in succession to the lower temperature level while the valve (5A) is closed.

4. Heat engine according to claim 3, wherein the working gas is cooled down to the lower temperature level in another second heat exchanger (1B) which is chronologically displaced to the first heat exchanger and after opening the second valve (5B), is compressed with simultaneous heat transfer to this heat exchanger (1B), wherein the before expanded working gas flows out of the working cylinder (2) into the second heat exchanger (1B) and again performs work with the working piston (3), wherein at the time of expansion of the compression procedure in the heat exchanger (1B) the second valve (5B) assigned to this heat exchanger (1B) closes, and with the closed second valve 5B the heat exchanger (1B) is heated up in the further process to the upper temperature level.

5. Heat engine according to claim 4, wherein chronologically displaced the working gas is heated up to the upper temperature level in a further third heat exchanger (1C) by external heat source and after opening of the third valve (5C) assigned to the heat exchanger (1C) expands with simultaneous heat supply, wherein the working gas, compressed before, flows out of the third heat exchanger (1C) into the working cylinder (2) and performs work and the third heat exchanger (1C) is in succession cooled down to the lower temperature level with closed third valve (5C) by external source.

6. Heat engine according to claim 5, wherein the enclosed working gas in the first heat exchanger (1A) is cooled down to the low temperature level and compresses by opening the first valve (5A), assigned to the first heat exchanger (1A), and heat is dissipated during the compression procedure of the first heat exchanger (1A), wherein work is performed in the working cylinder (2) by compression, and after closing of first valve (5A) the first heat exchanger (1A) is heated up again, wherein similarly by opening the appropriate second valve (5B), working fluid expands out of the heated up, second heat exchanger (1B), followed by a compression in the cooled down third heat exchanger (1C).

7. Heat engine according to claim 1, wherein suitable heat exchangers (1) are used to heat up and cool down the working fluid for the certain heating or cooling medium.

8. Heat engine according to claim 7, wherein the valves (5A, 5B and 5C) are opened and closed in a specific order and specific rhythm by means of a cam shaft (6), electric drive or a similar valve actuator (6).

9. Heat engine according to claim 8, wherein the working piston (3) is magnetized by permanent or excited magnets (7) to transmit work, the working cylinder (2) is fitted with an electrical coil (8) in such a manner, that by movements of the working piston 3 power is generated, the work of the piston (3) is converted directly into electrical power.

10. Heat engine according to claim 9, wherein a pressure balancing tank (9) is attached to the working cylinder (2) on the opposing side of the working cylinders connections.

11. Heat engine according to claim 10, wherein a pressure balancing tank (9) is filled with the same working gas as the heat exchangers (1).

12. Heat engine according to claim 10, wherein the pressure of the pressure balancing tank (9) is adapted to the static pressure of the heat exchangers (1A, 1B, 1C).

13. Heat engine according to claim 10, wherein the heat engine can be operated independently of the atmospheric pressure with each suitable pressure of the working gas.

14. Heat engine according to claim 1, with any odd number of heat exchangers, which are connected to a common working cylinder (2) by means of connecting pipes (4) and valves (5).

15. Heat engine according to claim 14, wherein with the same odd number of heat exchangers (1), valves (5) and connections or connecting pipes (4) are connected to both sides of the working cylinder (2), and wherein the period of a cycle on both sides of the working cylinder is identical and the valves (5) arranged on two sides are actuated in such a manner, that with a compression on one side an expansion takes place simultaneously on the other side.

16. Heat engine according to claim 15, having any odd number of heat exchangers (1), connections, connecting pipes (4) and the corresponding valves (5), which are attached to both sides of the same working cylinder (2).

17. Heat engine according to claim (1), where the heating and separately the cooling medium flows simultaneously through the heat exchangers (1), which are arranged exactly aligned on opposite ends of the working cylinder (2).

18. Heat engine according to claim 16, wherein an arrangement of several working cylinders (2), piston (3), connections (4), valves (5) and valve actuators (6) exist, which all are connected parallel to any number of common heat exchangers (1).

19. Heat engine according to claim 15, wherein a working gas is used, its boiling point being, according to the selected pressure, between the lower and upper temperature level, so that a condensation takes place during the isochoric heat extraction and compression, and evaporation takes place during the isochoric heat input and expansion.

20. Heat engine according to claim 15, where heat exchangers (1) all are arranged in a star shaped manner around the longitudinal axis of the working cylinder (2) and the connecting pipes (4) are attached alternately to both sides of the working cylinder (2), where the heat exchangers (1) are rigidly connected to the working cylinder (2) and rotate with the same around the common longitudinal axis, so that the individual heat exchangers (1) are immerged half of the rotation in the cooling medium and the other half in the heating medium.

21. Heat engine according to claim 20, wherein the heat exchangers (1) have a flat construction and the shape of a disk segment to provide a radiation absorber, and arrangement around the longitudinal axis of the working cylinder (2), in such a manner that it forms a disk, wherein they are equipped with an radiation-absorbing surface and constructed also for cooling by convection, since the taken up heat must be transferred again to the environment, wherein heat exchanger (1), connecting pipes (4) and valves (5), are rigidly connected with the working cylinder (2) and rotate with the same one around the common central axis.

22. Heat engine according to claim 21, wherein half of the heat exchangers (1) are exposed to radiation, while the other half of the heat exchangers (1) is being shadowed.

23. Heat engine according to claim 21, wherein the shadowing elements are composed from different layers, and the side facing the radiation source has a reflecting surface (23), an insulating layer (21) underneath and on the reverse side a cover layer (24) with grey or dark surface, which absorbs the radiation of the heat exchangers (1) after been shadowed and thus contributes to the removal of the heat by convection.

24. Heat engine according to claim 21, wherein the heat exchangers (1), which are exposed to the radiation, are protected by a cover against loss by convection and radiation, and wherein the said covering is constructed on the front side with a glass (19), side walls and the back with a multilayer cover (20 to 22), wherein the inside of this cover facing the heat exchangers (1) facing layer (22), is curved and reflecting, while the middle (21) layer is an insulating layer and the outside layer (20) an enclosure layer.

25. Heat engine according to claim 21, wherein the heat exchangers (1) rotate around the centre of the absorber annulus, and each heat exchanger (1) thereby alternately passes the shading and covering, wherein by doing so they alternately are heated up through radiation and are cooled down while being shadowed, by delivering the environment with heat.

26. Heat engine according to claim 21, wherein the valves (5) are controlled in such a manner that alternately a cooled and warmed up heat exchanger (1) is connected to the working cylinder (2), in order to perform work by expansion or compression.

27. Heat engine according to claim 21 having odd number heat exchangers (1), which alternately are attached each to one and the other side of the working cylinder (2).

28. Heat engine with external heat source and at least 3 heat exchangers (1) with enclosed working gas, which are alternately cooled and heated, wherein the thermodynamic changes of state in each heat exchanger (1) are connected to a working cylinder (2) and valve actuators (5) and (6), and wherein the successively following changes of state occur: a) isochoric heat supply, b) isothermal expansion, c) isochoric heat dissipation and d) isothermal compression; wherein said expansion and said compression do not take place with the same working gas, and wherein after expansion from a heated heat exchanger (1) into the working cylinder (2), a compression in another cooled heat exchanger (1) follows, and depending on the heating/cooling procedure, expansion and compression are actuated by means of valves in between individual heat exchangers (1) and working cylinder (2).

29. Heat engine with at least 3 or more closed heat exchangers (1), which perform work together with a working cylinder (2) and working piston (3), wherein an own Stirling cycle takes place in each heat exchanger (1) with working cylinder (2) and working piston (3) chronologically displaced towards the other heat exchanger (1).

30. Heat engine according to claim 28, wherein the individual cycles are separated by the employment of valves (5).

31. Heat engine according to claim 28 where the heat exchanger (1) forms a closed space providing a working fluid, which is further designed for an optimized heat exchange between working fluid and environment, wherein a part of the heat exchanger (1) is thermally decoupled from the other part by an insulating layer (25), which is inserted in between them, wherein one part is cooled and the other one is heated, wherein a mechanical closing device (26) is inserted in between the cooled and heated part, in order to divide the enclosed space of the heat exchanger (1) into two spaces if necessary, wherein a connective opening in the wall of the heated part of the heat exchanger (1) exists where the working fluid is able to flow in and out.

32. Heat engine according to claim 31, with any number of heat exchangers (1) star shaped and symmetrically in their arrangement around a working cylinder (2) and rigidly connected to it, wherein the connective openings of the heat exchangers (1) are connected to the working cylinder (2) by connections or connecting pipes 4, so that an exchange of the working gas is possible in between both, wherein one half of the heat exchangers (1) is attached to the facing side of the working cylinder (2), the other half to the opposing one, wherein always one heat exchanger (1) is connected alternately to one side, the next said heat exchanger (1) connected to the other side, wherein valves (5) are in the connections (4) between heat exchanger (1) and working cylinder (2), which are operated by means of a valve actuator (6) to be opened and closed, while working cylinder (2), heat exchanger, (1) connecting pipes (4) and valves (5) are rotating around the longitudinal axis of the working cylinder (2) to describe a rotor.

33. Heat engine according to claim 32, wherein a working gas is used, its boiling point being in between the lower and upper temperature level according to the selected pressure, so that a condensation takes place, while there is the isochoric heat extraction and compression and an evaporation takes place while there is the isochoric heat input and expansion.

34. Heat engine with heat exchangers (1) according to claim 32, wherein the cooled part of the heat exchangers (1) is on the external side and the heated part is on the internal side, wherein the cooled part over half of the extent is cooled by a cooling medium and the heated part is heated over the opposite half of the extent, while the rotor is rotating, said rotor comprising a heat exchanger (1), working cylinder (2) with piston (3), connecting pipes (4) and valves (5).

35. Heat engine according to claim 32, with the valve (5) opening and closing twice, in between each heat exchanger (1) and working cylinder (2) during one rotation of the rotor, once during the cooling procedure and once during the heating procedure.

36. Heat engine according to claim 32, with the connections being closed in between the cooled and heated parts of the heat exchangers (1), with a closing device (26) during the heating procedure.

37. Heat engine according to claim 36, with the internal heat of the material of the heated part of the heat exchangers (1) being used by circulation of the heating and cooling medium, within a segment briefly after completion of the heating procedure, in order to heat up the cooled part of the heat exchangers (1), within a segment briefly after completion of the cooling procedure, in order to minimize a condensation in the cooled part during the heating of the heated part.

38. Heat engine according to claim 37, wherein the heated parts of the heat exchangers (1) are designed as radiation absorbers, wherein the heated parts of the heat exchangers (1) are flat and have the form of a disk segment, and in such a manner annular shaped around a centre that a disk is formed, wherein they are equipped with a radiation-absorbing surface, wherein these radiation absorbers are protected from losses by convection and radiation by means of a cover that is constructed on the front side with a glass (19), side walls and the back with a multilayer cover (20 to 22), wherein the inside of this cover facing the heat exchangers (1), facing layer (22), is curved and reflecting, while the middle (21) layer is an insulating layer and the outside layer (20) an enclosure layer.

39. Heat engine according to claim 36 with at least 3 or more closed heat exchangers (1), which perform work together with a common working cylinder (2) and a working piston (3), wherein its own Stirling cycle combined with a Clausius Rankine similar cycle is taking place in each heat exchanger (1) with working cylinder (2) and working piston (3), chronologically displaced to the other heat exchangers (1).

40. Heat engine according to claims 36, having their impact based on the following changes of state in a cycle: 1. isochoric extraction of heat, 2. isobaric condensation, 3. isothermal compression, 4. isochoric heat input, 5. isobaric evaporation and 6. isothermal expansion.

41. Heat engine according to claim 1, connected in series to an arbitrary number of heat engines (A), wherein a heating medium (30) consisting of flue gases (30) from a combustion process that consecutively pass separate heat engines (A) in a cascade like manner, wherein the temperature of the heating medium (30) decreases while passing through the heat exchangers (1) of the heat engines (An to A1) and wherein a cooling medium (22) which consists of ambient air or other air, passes in a cascade like manner through the same heat engines (A1 to An) in opposite direction and in a reversed sequence, wherein the cooling medium temperature increases while passing the heat exchangers (1) of the heat engines (A), wherein the temperature difference between the heating and cooling medium remains more or less constant, and every heat engine (A) performs work and thereby generates electric power, wherein the cooling medium is utilized as combustion air (22) in a combustion process after exiting the last heat engine (A) of the cascade, and wherein the heating medium (30) is utilized for heating purposes or other heat consumers after exiting the last heat engine (A1).

42. Heat engine according to claim 1, connected in series to an arbitrary number of heat engines (A) according to claim 1, wherein a heating medium (30) consisting of flue gases (30) from waste heat from other processes that consecutively pass separate heat engines (A) in a cascade like manner, wherein the temperature of the heating medium (30) decreases while passing through the heat exchangers (1) of the heat engines (An to A1) and wherein a cooling medium (22) which consists of ambient air or other air, passes in a cascade like manner through the same heat engines (A1 to An) in opposite direction and in a reversed sequence, wherein the cooling medium temperature increases while passing the heat exchangers (1) of the heat engines (A), wherein the temperature difference between the heating and cooling medium remains more or less constant, and every heat engine (A) performs work and thereby generates electric power, wherein the heating medium (30) is utilized for heating purposes or other heat consumers after exiting the last heat engine (A1).

* * * * *